US006329980B1

(12) United States Patent
Uehara et al.

(10) Patent No.: US 6,329,980 B1
(45) Date of Patent: Dec. 11, 2001

(54) DRIVING CIRCUIT FOR DISPLAY DEVICE

(75) Inventors: Hisao Uehara, Ogaki; Mitsugu Kobayashi, Nagoya; Yusuke Tsutsui, Motosu-gun, all of (JP)

(73) Assignee: Sanjo Electric Co., Ltd., Osaka (JP)

( * ) Notice: Subject to any disclaimer, the term of this patent is extended or adjusted under 35 U.S.C. 154(b) by 0 days.

(21) Appl. No.: 09/049,487

(22) Filed: Mar. 27, 1998

(30) Foreign Application Priority Data

| | | |
|---|---|---|
| Mar. 31, 1997 | (JP) | 9-081475 |
| Mar. 31, 1997 | (JP) | 9-081478 |
| Feb. 10, 1998 | (JP) | 10-028708 |
| Feb. 10, 1998 | (JP) | 10-028709 |

(51) Int. Cl.[7] ..... G09G 5/00
(52) U.S. Cl. ..... 345/204; 208/87; 208/94
(58) Field of Search ..... 345/204, 100, 345/94, 95, 87, 208, 55, 58; 348/807; 315/383

(56) References Cited

U.S. PATENT DOCUMENTS

| | | | | |
|---|---|---|---|---|
| 5,392,070 | * | 2/1995 | Endo et al. | 348/247 |
| 5,399,947 | * | 3/1995 | Washburn | 345/100 |
| 5,442,370 | * | 8/1995 | Yamazaki et al. | 348/807 |
| 5,532,765 | * | 7/1996 | Inoue et al. | 345/94 |
| 5,805,130 | * | 9/1998 | Yamamoto et al. | 315/383 |
| 5,905,484 | * | 5/1999 | Verhulst | 345/98 |
| 6,118,421 | * | 9/2000 | Kawwaguchi et al. | 345/89 |

* cited by examiner

*Primary Examiner*—Chanh Nguyen
*Assistant Examiner*—Fritz Alphonse
(74) *Attorney, Agent, or Firm*—Hogan & Hartson, L.L.P.

(57) ABSTRACT

A signal driving circuit for an active matrix type display device having display pixels arranged in a matrix, comprises a signal waveform correcting circuit receiving an input pixel signal for generating a corrected output pixel signal to the display device, said signal waveform correcting circuit including a delay circuit for generating a delay signal, a difference calculating circuit for calculating a difference signal between the input pixel signal and the delay signal, and a correction circuit for generating the corrected output pixel signal based upon the difference signal and the input pixel signal, wherein a portion of the waveform amplitude of the corrected output pixel signal is formed by adjusting a corresponding portion of the waveform amplitude of the input pixel signal based upon the difference signal.

17 Claims, 29 Drawing Sheets

DRIVING CIRCUIT FOR DISPLAY DEVICE

BACKGROUND OF THE INVENTION

1. Field of the Invention

The present invention relates to a circuit and method for driving a display device, and more particularly to a driving circuit and method for correcting a pixel signal to be finally applied to a display pixel in consideration of distortion thereof.

2. Description of the Prior Art

A flat panel display such as a liquid crystal display (LCD), an organic electroluminescence (EL) display or a plasma display has been extensively developed. In particular, the LCD is excellent because it is thin and consumes less power, and has provided the mainstream monitor displays in the field of AV equipment and OA equipment.

The LCD has a liquid crystal provided between a pair of opposed substrates. A large number of electrodes for applying an electric field to the liquid crystal to be driven are formed on an opposed internal face of each substrate. A display pixel is formed as a capacitor using the liquid crystal for a dielectric layer. The display pixels are arranged in a matrix. In particular, matrix arrangement of display elements to which a thin film electric field effect transistor (TFT) is connected as a switching element is referred to as an active matrix type. With the active matrix type, a display pixel voltage is sequentially applied and is held for a non-selection period so that display can be continued. Consequently, a display screen of high quality can be obtained.

In recent years, a polycrystalline semiconductor, particularly polysilicon (p-Si), has been used in place of an amorphous semiconductor which has been utilized as a TFT for an active layer, particularly amorphous silicon (a-Si), so that a switching operating speed can be increased. Consequently, an aperture can be enlarged with a reduction in size of the TFT, or high resolution and the like can be obtained by a reduction in a size of the display element. Thus, very high quality can be obtained. Furthermore, it is required that a driving circuit for driving the display element should operate at a higher speed than the display element. However, CMOS can be formed using a p-SiTFT so that the driving circuit can be built integrally in the same substrate. The LCD with a built-in driver can be manufactured at a low cost and an frame portion on the periphery of a display screen can be reduced in size. Consequently, mass production has been desired.

FIG. 1 shows a structure of an LCD module. Composite video signals VIDEO for R, G and B are sent from the outside to a video interface circuit [I/F]. The video interface circuit [I/F] generates predetermined original pixel signals VDR, VDG and VDB. The original pixel signals VDR, VDG and VDB and are sent to a drain driver [D/D] of an LCD panel through a buffer circuit [B/F]. A synchronizing signal SYNC is sent from the outside to a timing controller [T/C] so that various timing control signals are generated. In the video interface circuit [I/F], the original pixel signals VDR, G and B are split and expanded into a plurality of phases on the basis of a sample-and-hold signal generated by the timing controller [T/C] as will be described below in more detail. The drain driver [D/D] samples the original pixel signals VDR, G and B on the basis of a horizontal shift clock and a horizontal start pulse generated by the timing controller [T/C] to control a sampling operation as will be described below. Agate driver [G/D] of the LCD panel is mainly formed by a vertical shift register, and receives a vertical shift clock and a vertical start pulse from the timing controller [T/C].

The LCD panel has a large number of gate lines [GL] and drain lines [DL] arranged vertically and horizontally. At an intersection part, the TFT acting as the switching element, a liquid crystal capacitor [LC] acting as the display pixel connected to the TFT, and an auxiliary capacitor [SC] for charge storage are provided to form the display element. The gate driver [G/D] scans rows to sequentially select the gate line [GL]. The drain driver [D/D] samples original pixel signals and sequentially sends pixel signals in order to drive each display element for a row selection period. The TFT formed in a display section is a p-SiTFT. The gate driver [G/D] and the drain driver [D/D] also have a CMOS constructed by a p-SiTFT having the same structure of the display section p-SiTFT. Thus, the LCD panel and the gate driver [G/D] and drain driver [D/D] are integrated on the same substrate.

FIG. 2 shows a structure of the drain driver, In FIG. 2, a horizontal shift registers [S/R] 61 are provided in an upper stage, a video data lines [VDL] 62 are provided in a middle stage, and a sampling switchs [SW] 63 are provided in a lower stage. Horizontal start pulses STH 1 and STH 2 and horizontal shift clocks SCK 1 and SCK 2 are sent from the timing controller [T/C] to the horizontal shift registers 61. Sampling pulses SP 1 and SP 2 are generated from each output stage of the shift register 61 so that a sampling switch 63 acting as an analog switch is sequentially turned on. Original pixel signals VDR, VDG and VDB for R, G and B are sent from the buffer circuit [B/F] to the video data lines 62. The original pixel signals VDR, VDG and VDB are sent to each drain line [DL] through the sampling switch 63 which is on. A voltage applied when the sampling switch 63 is turned off is sampled as a pixel signal PX. The original pixel signals VDR, VDG and VDB are split and expanded into 4-phase signals for R, G and B in the video interface circuit [I/F]. The 4-phase signals are sent to a video data line 62.

FIG. 3 is a timing chart showing the relationship between 4-phase original pixel data VDL 1, 2, 3 and 4 for R, G and B which are obtained by dividing and expanding an original pixel signal respectively and a shift clocks SCK1, SCK2 of the shift registers.

In this example, a 4-way split is performed. Each video data line 62 serially receives pixel data signal (Dn, Dn+1 . . . ) every four pixels as analog signals having a ¼ frequency on a time basis. In other words, the same pixel data for 4 dot periods are transmitted to each video data line. A sampling period, is a period for which a video data signal is sent to each four corresponding drain lines for R. G. B. through a transfer gate [SW] 63 is the last of the four dot periods and sampling is carried out at the end of the sampling period. Therefore, a delay of an original pixel signal is recovered during sampling so that an accurate pixel signal voltage is sampled.

A waveform of the original pixel signal is distorted by an integrating circuit having a parasitic resistance and a parasitic capacitance in the drain driver [D/D]. Such a distortion decreases an amplitude of a pixel signal voltage. Consequently, brightness or contrast ratio is reduced. In particular, a significant uneveness in quality of display is caused by the distortion of the waveform on an end distant from an end where the original pixel signal is sent out or a central portion of a screen in a display section in which pixels are arranged in a matrix. Furthermore, this problem has become remarkable with an increase in size of the substrate.

Referring to the same video data line 62, a pixel signal sent in a previous column affects a pixel signal voltage to be sent to a next column. As a result, the contents of display in some columns affect display in a column provided several columns apart corresponding to the split number. In case of 4-way split, for example, display in some columns affects a column provided four columns apart. In the dot sequential driving operation, furthermore, a signal is also distorted after sampling, that is, by an integrating circuit having a parasitic resistance and a parasitic capacitance of the drain line [DL], a TFT, a liquid crystal capacitor [LC] and an storage capacitor [SC]. Therefore, distortion of data to be finally written to a pixel cannot be ignored. Thus, if display information in a certain position affects a distant display position, a whole display screen is visually recognized as a ghost. Consequently, the quality of the display is deteriorated.

Furthermore, if a difference between a previous pixel signal voltage and a subsequent pixel signal voltage is great, the previous pixel signal voltage affects the next pixel signal voltage more greatly than in the case where the same difference is small. More specifically, if the difference between the previous pixel signal voltage and the subsequent pixel signal voltage is great, it takes a long time to change an original pixel signal voltage. For this reason, the subsequent pixel signal voltage is shifted by a level of the previous pixel signal voltage.

Such a problem can be solved to some extent by splitting the original pixel signal into a plurality of phases and reducing a frequency. However, less effects are obtained by a further reduction in a sampling period which is caused by high resolution of a display, and an increase in a parasitic capacitance and a parasitic resistance of a signal path which is generated by an increase in a screen size of the display.

In order to solve such a problem, it can be proposed that the split number should be further increased. However, this proposal is not preferable because structures of the signal processing circuit and the drain driver [D/D] become complicated and a cost of the circuit is increased.

SUMMARY OF THE INVENTION

The present invention has been made in order to solve the above-mentioned problems, and its object is to provide a driving circuit for a display device which corrects distortion of a pixel signal for driving each display device with a structure having a high quality of display and a small load therein.

In order to attain the above-mentioned object, the present invention provides a driving circuit for a display device, comprising a signal waveform correcting circuit for highlighting a rising edge and/or a falling edge of a waveform for a unit pixel period of an input pixel signal, and correcting a waveform of an output pixel signal, the signal waveform correcting circuit including a delay circuit for delaying the input pixel signal, a difference calculating circuit for calculating a difference between the input pixel signal and a delay signal of the input pixel signal output from the delay circuit, and a correction signal generator for generating a correction signal on the basis of a difference signal sent from the difference calculating circuit, a part of an amplitude of the input pixel signal being changed according to the correction signal.

In the above-mentioned structure, the difference calculating circuit is formed by a subtracter for performing subtraction of the input pixel signal and the delay signal output from the delay circuit to output a result of the subtraction as the difference signal, or by a comparator for comparing the input pixel signal with the delay signal output from the delay circuit and outputting a result of the comparison as the difference signal.

In the above-mentioned structure, furthermore, the correction signal generator amplifies or attenuates the amplitude of the difference signal sent from the difference calculating circuit, thereby generating a correction signal. The correction signal thus obtained is added to the input pixel signal so that a corrected pixel signal is generated.

In a display device having a plurality of display pixels arranged in a matrix, in the case where the display pixels are sequentially driven, a pixel signal for one unit pixel period which is to be sent to the display pixels is distorted by the influence of a pixel signal for a previous period, a parasitic capacitance and resistance in a display section, and the like. In particular, distortion is generated in a rising and/or falling edge portion (s) of a signal waveform. Signals in these edge regions are delayed to obtain a difference. Correction is performed according to the difference. Consequently, a signal having a wave form which is closer to an original pixel signal can be sent to the display pixel with a simple structure.

In another aspect of the present invention, a driving circuit for a display device comprises a signal waveform correcting circuit for highlighting a rising edge and/or a falling edge of a waveform in the vicinity of a boundary between unit pixel periods of an input pixel signal and correcting a waveform of an output pixel signal, the signal waveform correcting circuit including a delay circuit for delaying the input pixel signal by natural number m pixel periods, a difference calculating circuit for calculating a difference between the input pixel signal and a delay signal of the input pixel signal output from the delay circuit, a correction signal generator for generating a correction signal on the basis of an amplitude of a difference signal sent from the difference calculating circuit, and a signal split expansion circuit for generating, from the input pixel signal, m split pixel signals in an m-fold period of a pixel clock having pixel information every m pixel periods, for generating, from the correction signal, m split correction signals in an m-fold period of a pixel clock, and for outputting m corrected split pixel signals obtained by amplifying or attenuating a part of the split pixel signal by the split correction signal on the basis of the m split pixel signals and the m split correction signals corresponding thereto.

In the case where the pixel signal is divided into m phase and the display pixel is driven by using the split pixel signals every m pixel periods in order to relax an operating load of the driving circuit for driving a display pixel, split correction signals are generated corresponding to m kinds of split pixel signals. The split pixel signal and the split correction signal are switched and output in a predetermined timing. With a simple structure, consequently, a corrected split pixel signal can be generated by correcting a predetermined region of the split pixel signal.

In the above-mentioned structure, the signal split expansion circuit is constructed with m signal split circuits, and uses 1 to m sampling clocks having phases which are different from each other by a 1/m period and having m-fold period of a reference pixel clock of said input pixel, and said m signal split circuits forming m correction split pixel signals in phase which have different pixel information.

In the above-mentioned driving circuit for a display device, 1st to [m−1]th signal split circuits include respectively: a first latch circuit for latching said input pixel signal and said correction signal sent from said correction signal generator respectively on the basis of any of 1st to [m−1]th sampling clocks; a second latch circuit for latching respective output signals sent from said first latch circuit on the basis of an mth sampling clock; and a selecting circuit for selectively switching and outputting any of 1st to [m−1]th split pixel signals and any of corresponding 1st to [m−1]th split correction signals which are output from said second latch circuit on the basis of a predetermined selection clock, thereby generating corresponding 1st to [m−1]th corrected split pixel signals, and wherein an mth signal split circuit includes: a latch circuit for latching said input pixel signal and said correction signal sent from said correction signal generator on the basis of said mth sampling clock; a selecting circuit for selectively switching and outputting an mth split pixel signal and a corresponding mth split correction signal which are output from said latch circuit on the basis of a predetermined selection clock, thereby generating a corresponding mth corrected split pixel signal.

In yet another aspect of the present invention, a driving circuit for a display device which sequentially drives a plurality of display pixels arranged in a matrix, comprises a signal waveform correcting circuit for correcting an input pixel signal for driving each display pixel, wherein the signal waveform correcting circuit amplifies or attenuates an amplitude of an input pixel signal for a beginning predetermined period of a unit pixel period in which each display pixel is driven depending on a difference between the input pixel signal for a past unit pixel period and the input pixel signal for a current unit pixel period and a position of the display pixel on a display section corresponding to the current unit pixel period.

In the case where the display pixels arranged in a matrix are driven, a greater signal distortion is generated on a pixel signal which is actually sent to a display pixel in a position that is more distant from the driver for driving the display pixel than a display pixel closer to the driver. Accordingly, a uneveness in quality of display between the display pixels can reliably be suppressed by controlling a correction quantity depending on a difference signal and a position of the display pixel to be driven.

In the driving circuit for a display device, in the case where the pixel signal is split and expanded to drive each display pixel, the signal waveform correcting circuit includes a delay circuit for delaying said input pixel signal by a natural number m pixel periods; a difference calculating circuit for calculating a difference between said input pixel signal and a delay signal of said input pixel signal output from said delay circuit; a correction signal generator having a position information generator for generating position information of a corresponding display pixel and serving to generate a correction signal on the basis of said position information and a difference signal sent from said difference calculating circuit; and a signal split expansion circuit for generating, from said input pixel signal, m split pixel signals in an m-fold period of a pixel clock having pixel information every m pixel periods, for generating, from said correction signal, m split correction signals in an m-fold period of a pixel clock, and for generating corrected split pixel signals from said m split pixel signals and said m split correction signals corresponding thereto, wherein an amplitude of said split pixel signal for a beginning predetermined period of one unit pixel period of said m pixel periods is amplified or attenuated depending on a difference between said input pixel signal for a past unit pixel period and said input pixel signal for a current unit pixel period, and a position of said display pixel on a display section corresponding to said current unit pixel period.

In the above-mentioned driving circuit, the correction signal generator can further include a correction regulating circuit for outputting correcting data corresponding to the position information and a difference signal sent from the difference calculating circuit, and an adder—subtracter for performing addition or subtraction of the correcting data and the input pixel signal to generate the correction signal.

In the above-mentioned driving circuit, the signal split expansion circuit switches and selects the m split pixel signals and the corresponding m split correction signals in a predetermined period using a selecting circuit, or includes an adder—subtracter to add or subtract the corresponding m split correction signals to or from the m split pixel signals at a predetermined timing, thereby generating corrected split pixel signals.

In the present invention, the beginning predetermined period of the unit pixel period in which the amplitude of the split pixel signal is controlled is one pixel period of the input pixel signal. Consequently, timing control can be performed without a special clock generator. Furthermore, the signal distortion can be reliably recovered without affecting actual contents of display before the end of a sampling period in which a pixel signal is actually sent to each display pixel.

In a further aspect of the present invention, a driving circuit for a display device which sequentially drives a plurality of display pixels arranged in a matrix, comprises a signal waveform correcting circuit for correcting an input pixel signal for driving each display pixel, wherein the signal waveform correcting circuit amplifies or attenuates an amplitude of an input pixel signal for a beginning predetermined period of a unit pixel period corresponding to each display pixel depending on a difference between an input pixel signal for a plurality of past unit pixel periods and an input pixel signal for a current unit pixel period.

Furthermore, influence of a difference between an input pixel signal for a closer past unit pixel period and the input pixel signal for the current unit pixel period on the corrected input pixel signal is set greater than influence of a difference between an input pixel signal for a farther past unit pixel period and the input pixel signal for the current unit pixel period on the corrected input pixel signal.

The input pixel signal at the current unit pixel period is affected by a signal at a previous period as well as an input pixel signal immediately before. For this reason, if the input pixel signal obtained for the current unit pixel period is corrected on the basis of the past data, correction can be performed more accurately. Furthermore, the signal immediately before affects the current signal more greatly than the signal obtained for the previous period. According to the present invention, therefore, the correction quantity for the input pixel signal is determined in serious consideration of the signal obtained immediately before than the signals obtained before that.

In the driving circuit, in the case where each display pixel is driven in response to the split pixel signal, the signal waveform correcting circuit includes a delay circuit for delaying said input pixel signal by $\alpha \cdot m$ pixel periods, m being a natural number and $\alpha$ being an integer of 1 or more; a difference calculating circuit for calculating a difference between said input pixel signal and $\alpha$ delay signals obtained by a delay of $1 \cdot m$ to $\alpha \cdot m$ pixel periods and output from said delay circuit, respectively; a correction signal generator for generating a correction signal on the basis of a difference signals sent from said difference calculating circuit; and a signal split expansion circuit for generating, from said input pixel signal, m split pixel signals having pixel information every m pixel periods, for generating, from said correction signal, m split correction signals, and for generating corrected split pixel signals from said m split pixel signals and said corresponding m split correction signals, wherein said m pixel periods act as a unit pixel period, and an amplitude of said split pixel signal for a beginning predetermined period of said unit pixel period is amplified or attenuated in response to said correction signal.

The correction signal generator changes a first difference signal which is a difference between the input pixel signal and a delay signal obtained by delaying the input pixel signal by 1·m pixel periods on the basis of other (α−1) difference signals which are differences between the input pixel signal and delay signals obtained by a delay of 2·m pixel periods or more, thereby creating correcting data and generating a correction signal on the basis of the correcting data.

In the above-mentioned structure, the correction signal generator includes a correction calculating circuit for changing an amplitude of a first difference signal which is a difference between said input pixel signal and a delay signal obtained by delaying said input pixel signal by 1·m pixel periods on the basis of said amplitude and other (α−1) difference signals which are differences between said input pixel signal and delay signals obtained by a delay of 2·m pixel periods or more, thereby generating correcting data; and an adder—subtracter for performing addition or subtraction of said correcting data and said input pixel signal to generate a correction signal, and wherein said signal split expansion circuit includes: an original pixel signal split circuit for generating, from said input pixel signal, m split pixel signals in an m-fold period of a pixel clock having pixel information every m pixel periods; a correction signal split circuit for generating, from said correction signal, m split correction signals in an m-fold period of a pixel clock; and a selecting circuit for selectively switching said m split pixel signals and said corresponding m split correction signals in a predetermined period to output a corrected split pixel signal.

Alternatively, the signal split expansion circuit may include the adder—subtracter, in place of the selecting circuit, to add or subtract the corresponding m split correction signals to or from the m split pixel signals in the predetermined timing, thereby generating a correction split pixel signal.

DESCRIPTION OF THE PREFERRED EMBODIMENTS

Figure 1:
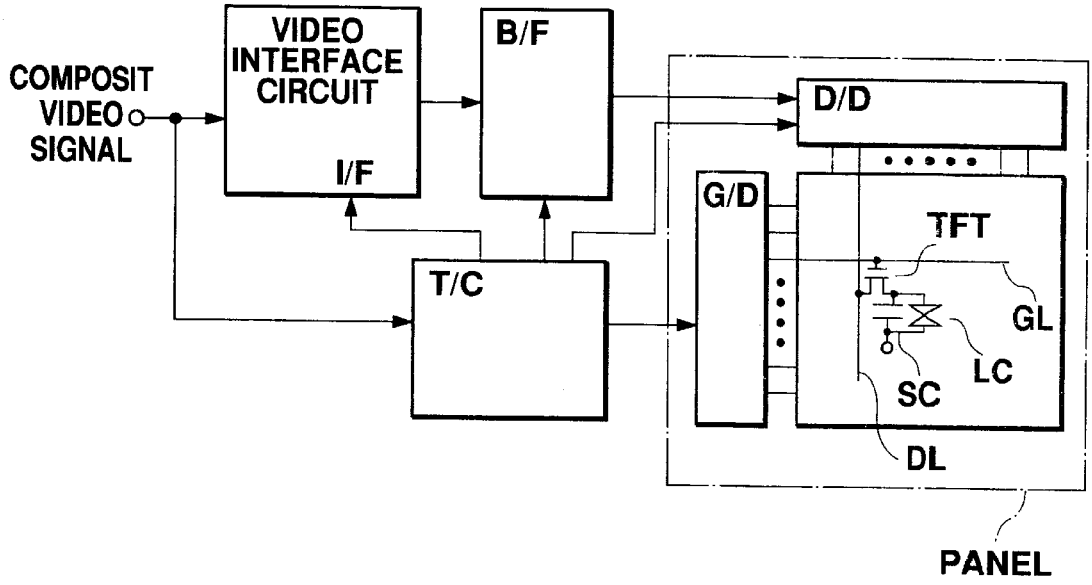
Fig. 1 PRIOR ART
FIG. 1 is a diagram showing a structure of an LCD device and a driving circuit thereof according to the prior art.

Each embodiment of the present invention will be described below with reference to the drawings. In the following description, the same reference numerals as those described above denote corresponding portions, and their description will be omitted.

FIRST EMBODIMENT

Figure 4:
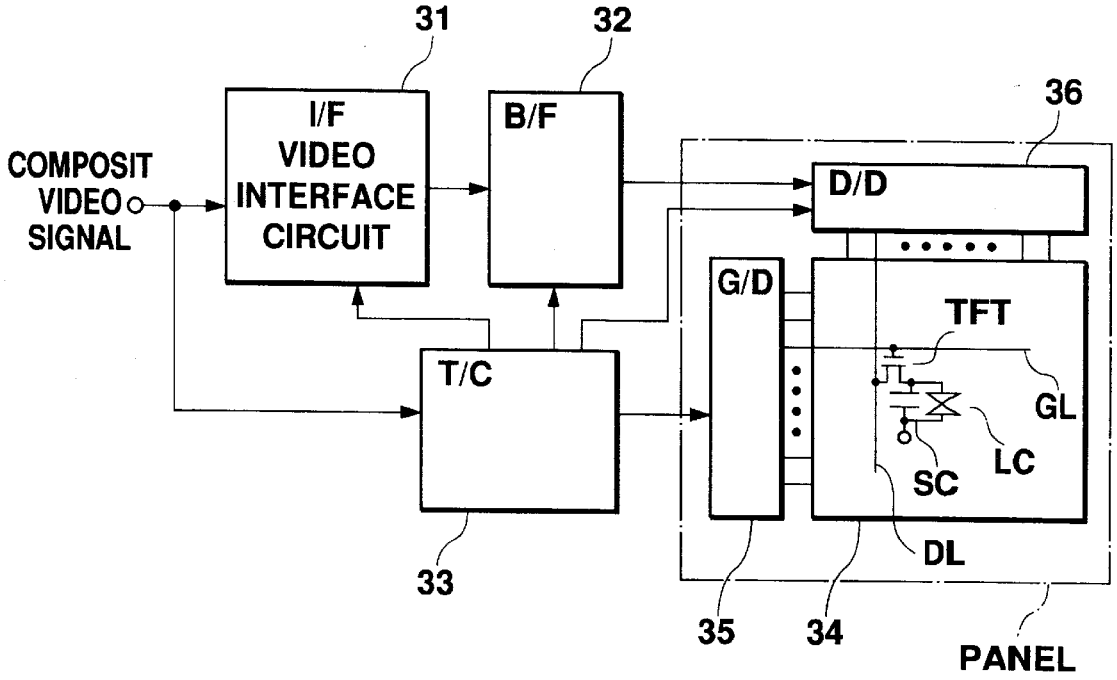
FIG. 4 is a diagram showing a structure of a driving circuit for an LCD device according to the present invention.

A driving circuit for an LCD according to a first embodiment of the present invention has a structure shown in FIG. 4, and comprises the video interface circuit [I/F] 31 similar to [I/F] in FIG. 1, a buffer circuit [B/F] 32 for a drain driver [D/D] 36, and a timing controller [T/C] 33, wherein the video interface circuit 31 includes a signal waveform correcting circuit for correcting a signal distortion between . The drain driver 36 has the similar structure as in FIG. 2.

Figure 5:
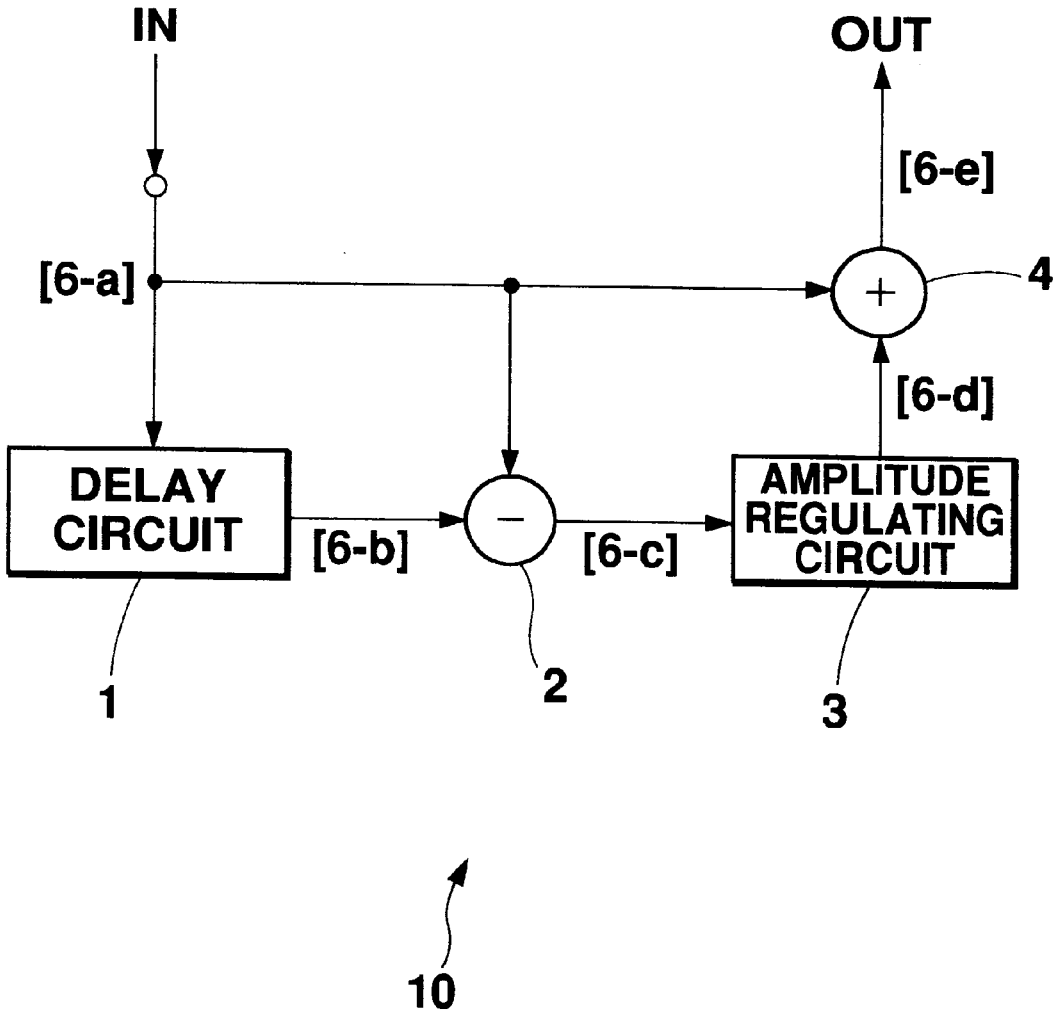
FIG. 5 is a diagram showing a structure of a signal waveform correcting circuit 10 according to the first embodiment of the present invention.

A structure of the signal waveform correcting circuit 10 includes a delay circuit 1, a subtracter 2, an amplitude regulating circuit 3 and an adder 4 as shown in FIG. 5. The signal waveform correcting circuit 10 may include the buffer circuit [B/F] 32 therein.

Figure 6:
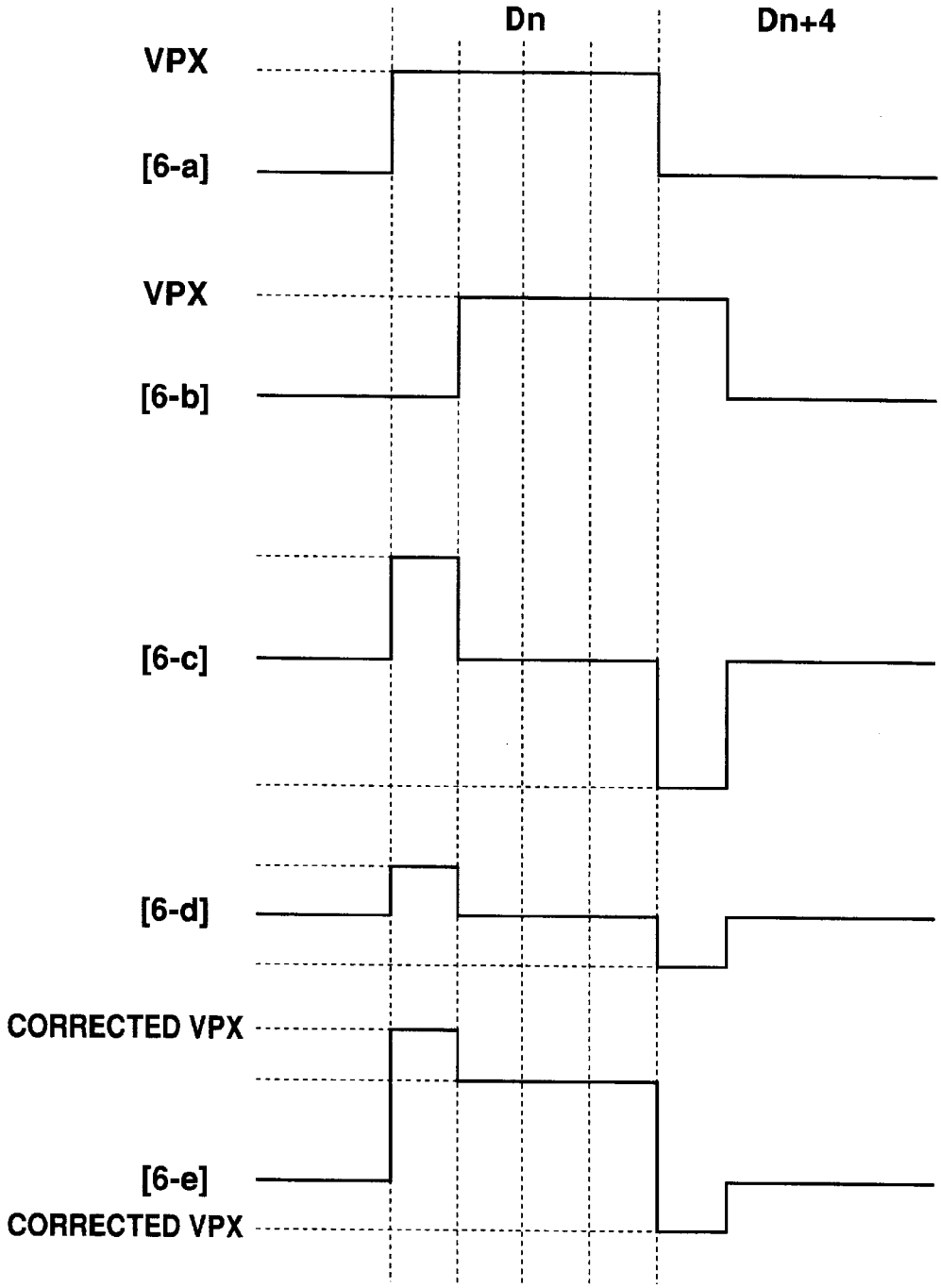
FIG. 6 is a diagram showing a waveform in each portion of the signal waveform correcting circuit 10 in FIG. 5.

FIG. 6 shows a signal waveform in each path of FIG. 5.

An original pixel signal output from the interface circuit 31 is sent to the delay circuit 1, the subtracter 2 and the adder 4. In the delay circuit 1, a sent original pixel signal [6-*a*] is delayed by a predetermined quantity (ex. a ¼ period of an original pixel signal split into four, that is, by one dot period). A difference between a delayed original pixel signal [6-*b*] obtained by the delay and the original pixel signal [6-*a*] is output from the subtracter 2. A difference signal [6-*c*] is caused to have a desirable amplitude by the amplitude regulating circuit 3 and is sent as a correction signal [6-*d*] to the adder 4. In the adder 4, the correction signal [6-*d*] is added to the original pixel signal [6-*a*]. Consequently, a corrected original pixel signal [6-*e*] is obtained. The corrected original pixel signal [6-*e*] has levels of waveform rising and falling portions corrected.

The amplitude regulating circuit 3 regulates an amplitude of the given difference signal [6-*c*] on the basis of the amplitude. If a difference between a previous amplitude and a subsequent amplitude is small, an amplitude of the correction signal [6-*d*] is greatly decreased and the correction signal [6-*d*] is added to the original pixel signal [6-*a*]. If the difference between the previous amplitude and the next amplitude is great, the amplitude of the correction signal [6-*d*] is slightly decreased, and the correction signal [6-*d*] is added to the original pixel signal [6-*a*].

For example, the amplitude regulating circuit 3 performs amplitude regulation to receive the difference signal [6-*c*] from the subtracter 2, to decide whether an amplitude of the difference signal [6-*c*] is equal to or greater than a predetermined value, and to change an amplification width of the amplitude.

The amplitude regulating circuit 3 decides a polarity of the change of the original pixel signal [6-*a*], that is, whether the same signal is at a rising edge or a falling edge, and changes the amplification width of the amplitude of the correction signal [6-*d*]. In a driver including a CMOS using p-Si, a delay signal quantity is sometimes varied at the rising and falling of the sent signal. Therefore, correction can be performed more properly by increasing a correction quantity if the delay quantity is great and by reducing the correction quantity if the delay quantity is small.

Figure 7:
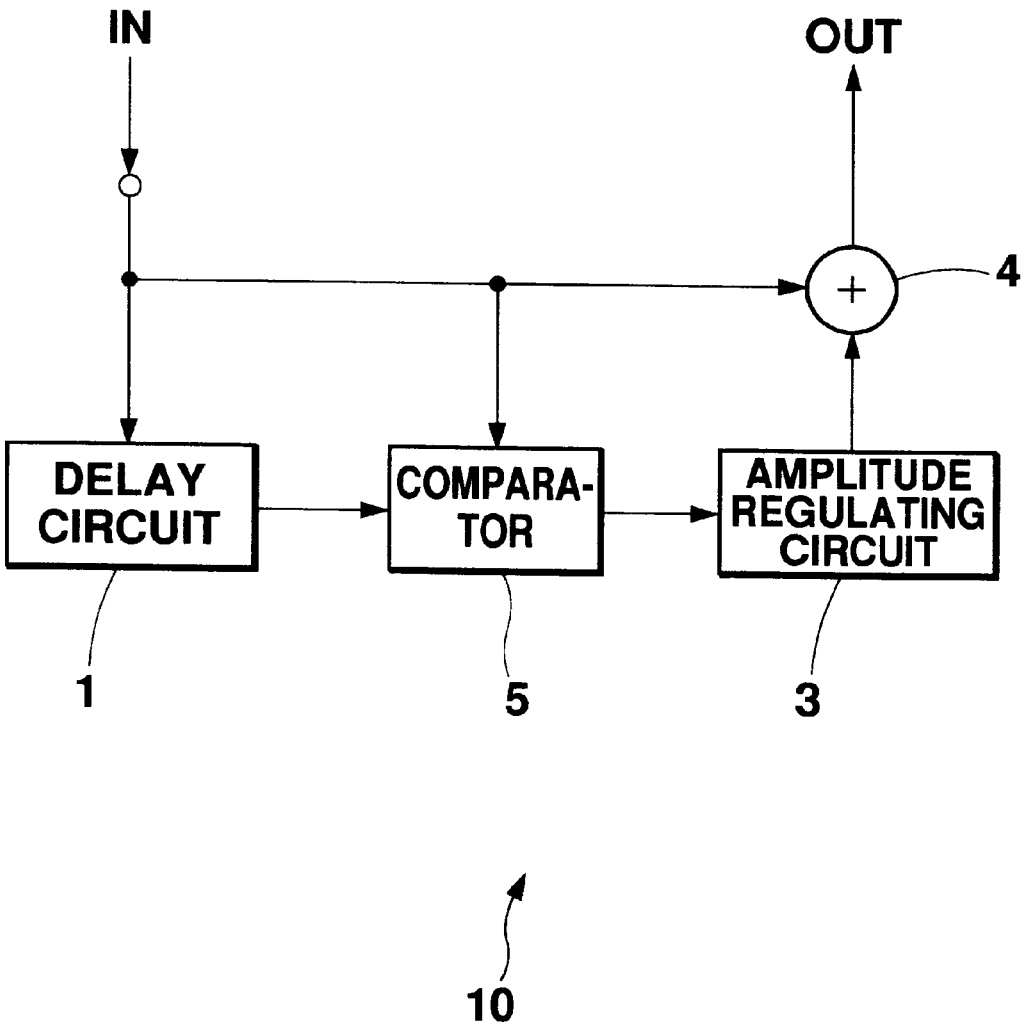
FIG. 7 is a diagram showing another example of the structure of the signal waveform correcting circuit in FIG. 5.

FIG. 7 shows an example of a structure of a signal waveform correcting circuit 10 which is different from the structure in FIG. 5. The signal waveform correcting circuit 10 shown in FIG. 7 is different from the signal waveform correcting circuit 10 shown in FIG. 5 in that a comparator 5 is used in place of the subtracter 2. Also in the structure shown in FIG. 7, a waveform can be properly corrected in the same manner as in the signal waveform correcting circuit 10 shown in FIG. 5.

Figure 8:
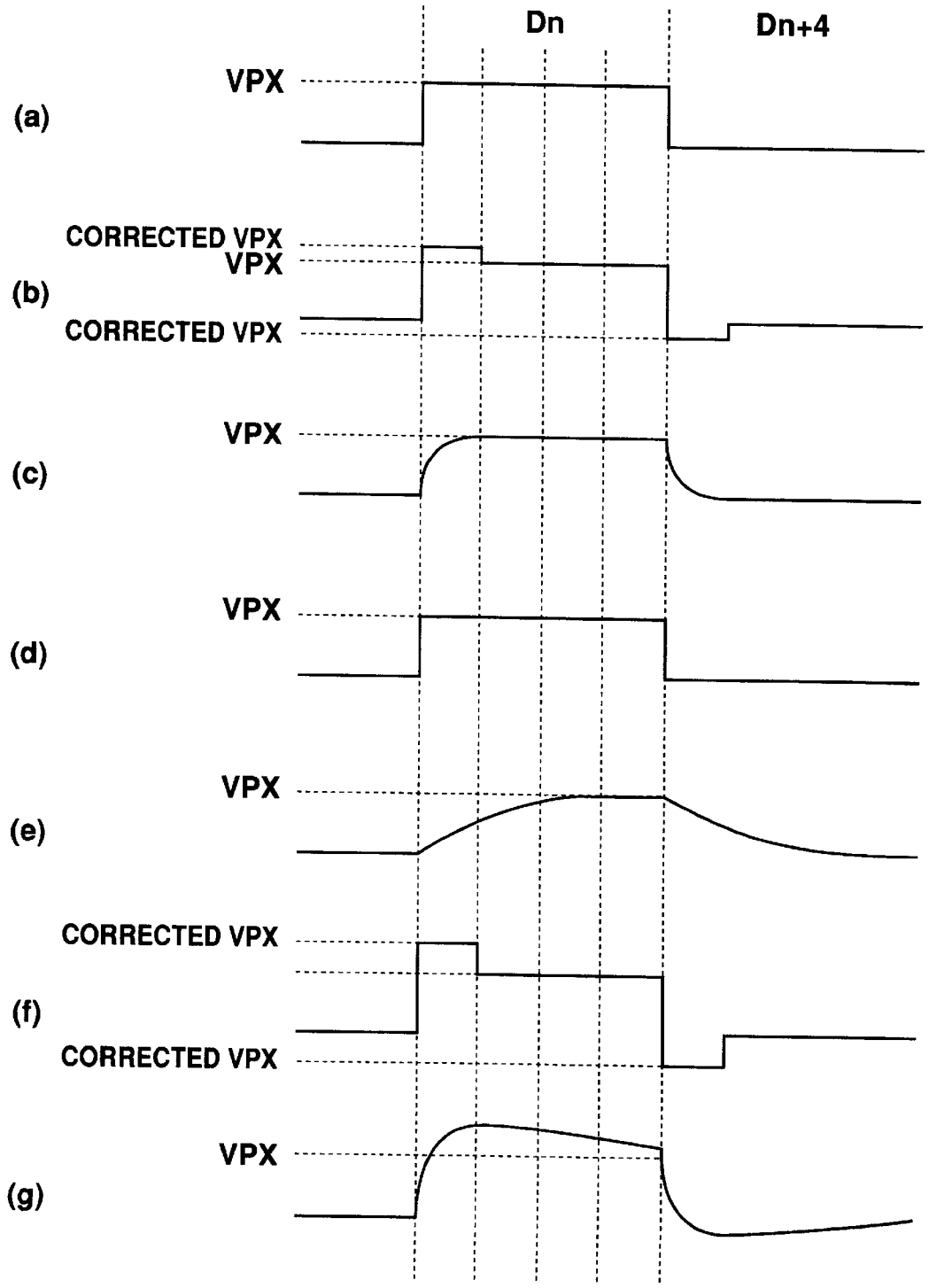
FIG. 8 is waveform diagram showing a comparison between signal waveforms obtained when an original pixel signal is not corrected and when the original pixel signal is corrected in the case where a change in the original pixel signal is small.

FIG. 8 shows an actual signal waveform on a video data line [VDL] 62 in a drain driver 36 which is obtained when an amplitude difference is comparatively small before and after a rising edge (or a falling edge) of one original pixel signal sent to the drain driver 36.

FIG. 8(*a*) shows a waveform of an original pixel signal, FIG. 8(*b*) shows a corrected original pixel signal which is obtained by correcting an edge of the original pixel signal in FIG. 8(*a*) in accordance with the first embodiment, and FIG. 8(*c*) shows a waveform obtained when the corrected original pixel signal is actually output to the drain driver.

FIG. 8(*d*) shows a signal waveform obtained when the waveform of the original pixel signal is not corrected as in the prior art, and FIG. 8(*e*) shows an actual output waveform of the original pixel signal which is not corrected. Furthermore, FIG. 8(*f*) shows a waveform obtained when the original pixel signal is corrected by a constant quantity, and FIG. 8(*g*) shows an actual output waveform in FIG. 8(*f*).

In the first embodiment, edges of the original pixel signal, that is, rising or falling edges are corrected to change an original level VPX into a suitable correction VPX level as shown in FIG. 8(*b*). Accordingly, even if a signal delay occurs in the signal path, the actual output waveform has a very small signal distortion as shown in FIG. 8(*c*) and a voltage level of the waveform is recovered to an object voltage level VPX shortly after a start of a Dn period.

Furthermore, the original pixel signal shown in FIG. 8 is slightly changed before and after rising and falling edge, respectively. Therefore, even if the original pixel signal is not corrected as shown in FIGS. 8(*d*) and 8(*e*), signal distortion caused by a signal delay does not affect an end of sampling period. The reason for this is as follows. The original pixel signal is split and expanded into a plurality of the pixel signal to set a low signal frequency on each video data line shown in FIG. 2. Therefore, the signal distortion caused by the signal delay is recovered to the object voltage level VPX for the end of the sampling period as shown in FIG. 8(*e*).

However, in the case where the correction quantity is fixed as shown in FIGS. 8(*f*) and 8(*g*) irrespective of small change widths obtained before and after the rising and falling edges of the original pixel signal, the correction quantity becomes excessive and the influence of the edges of the highlighted corrected original pixel signal (FIG. 8(*f*)) has not been recovered for the end of the sampling period either.

Figure 9:
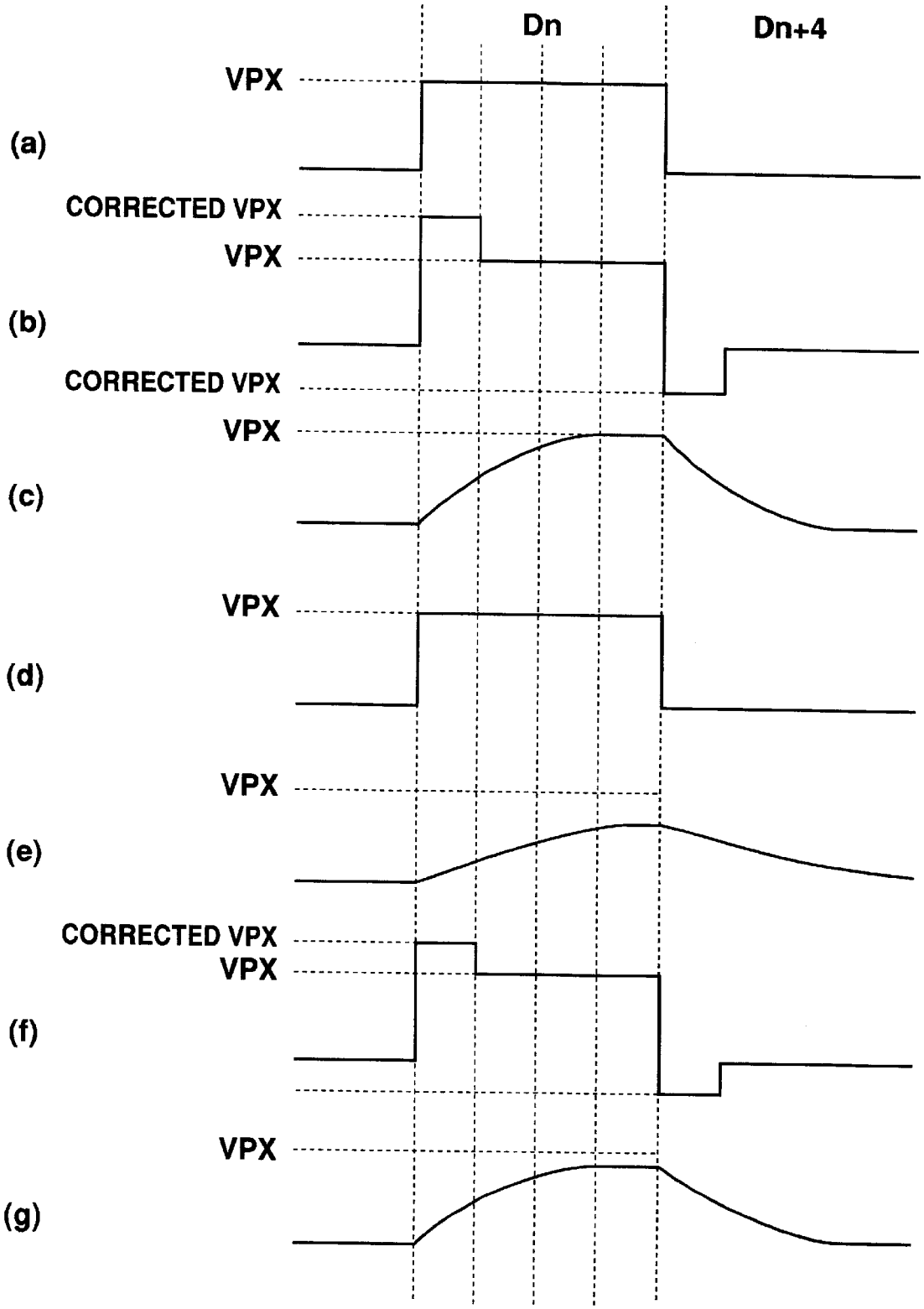
FIG. 9 is waveform diagram showing a comparison between signal waveforms obtained when the original pixel signal is not corrected and when the original pixel signal is corrected in the case where the change in the original pixel signal is great.

FIG. 9 shows waveforms of a corrected original pixel signal and a non-corrected original pixel signal, and actual output waveforms of these signals which are obtained when change widths are great before and after rising or falling edges of the original pixel signal in reverse to FIG. 8. FIG. 9(*a*) shows a waveform of an original pixel signal, FIG. 9(*b*) shows a corrected original pixel signal obtained by correcting an edge of the original pixel signal in FIG. 9(*a*) in accordance with the first embodiment, and FIG. 9(*c*) shows a waveform obtained when the corrected original pixel signal is actually output to the drain driver. In FIG. 9, a waveform change in the original pixel signal is great. As shown in FIG. 9(*b*), therefore, a correction quantity of the waveform is greater than the correction quantity in FIG. 8(*b*). Thus, the correction quantity itself is regulated. Consequently, if the change in the original pixel signal is great as shown in FIG. 9, the correction quantity is large so that a distortion caused by a signal delay can sufficiently be recovered for the end of the sampling period (see FIG. 9(*c*)).

FIG. 9(*d*) shows a signal waveform obtained when the waveform of the original pixel signal is not corrected as in the prior art, and FIG. 9(*e*) shows an actual output waveform of the original pixel signal which is not corrected. As is apparent from these drawings, when a change in the original pixel signal is large, the signal distortion caused by the signal delay is not reached to the object voltage level VPX before the end of the sampling period even if the original pixel signal is split and expanded to set a low signal frequency on each video data line 62 in FIG. 2.

Furthermore, FIG. 9(*f*) shows a waveform obtained when the original pixel signal is corrected by a constant quantity. If a change in the original pixel signal is large as shown in FIG. 9, a correction quantity for the change is too small, that is, insufficient when the correction quantity is constant. For this reason, it is apparent that a signal level in an actual output waveform shown in FIG. 9(*g*) cannot reach the object voltage level VPX at the end of the sampling period, resulting in the influence of a voltage of a previous original pixel signal on a voltage level of a next original pixel signal.

In the first embodiment described with reference to FIGS. 8 and 9, the original pixel signal is corrected according to the change obtained before and after the rising or falling edge thereof, that is, the original pixel signal is slightly corrected with a small change and is greatly corrected with a large change. As a result, the influence of the delay of the original pixel signal can be suppressed. Consequently, also in the case where a pixel signal voltage for display is to be sampled from the original pixel signal, a desirable amplitude can be obtained. Therefore, a brightness and a contrast ratio can be prevented from being reduced, or display quality can be prevented from being deteriorated by the influence of display of a previous pixel on a subsequent pixel during sampling.

SECOND EMBODIMENT

Figure 10:
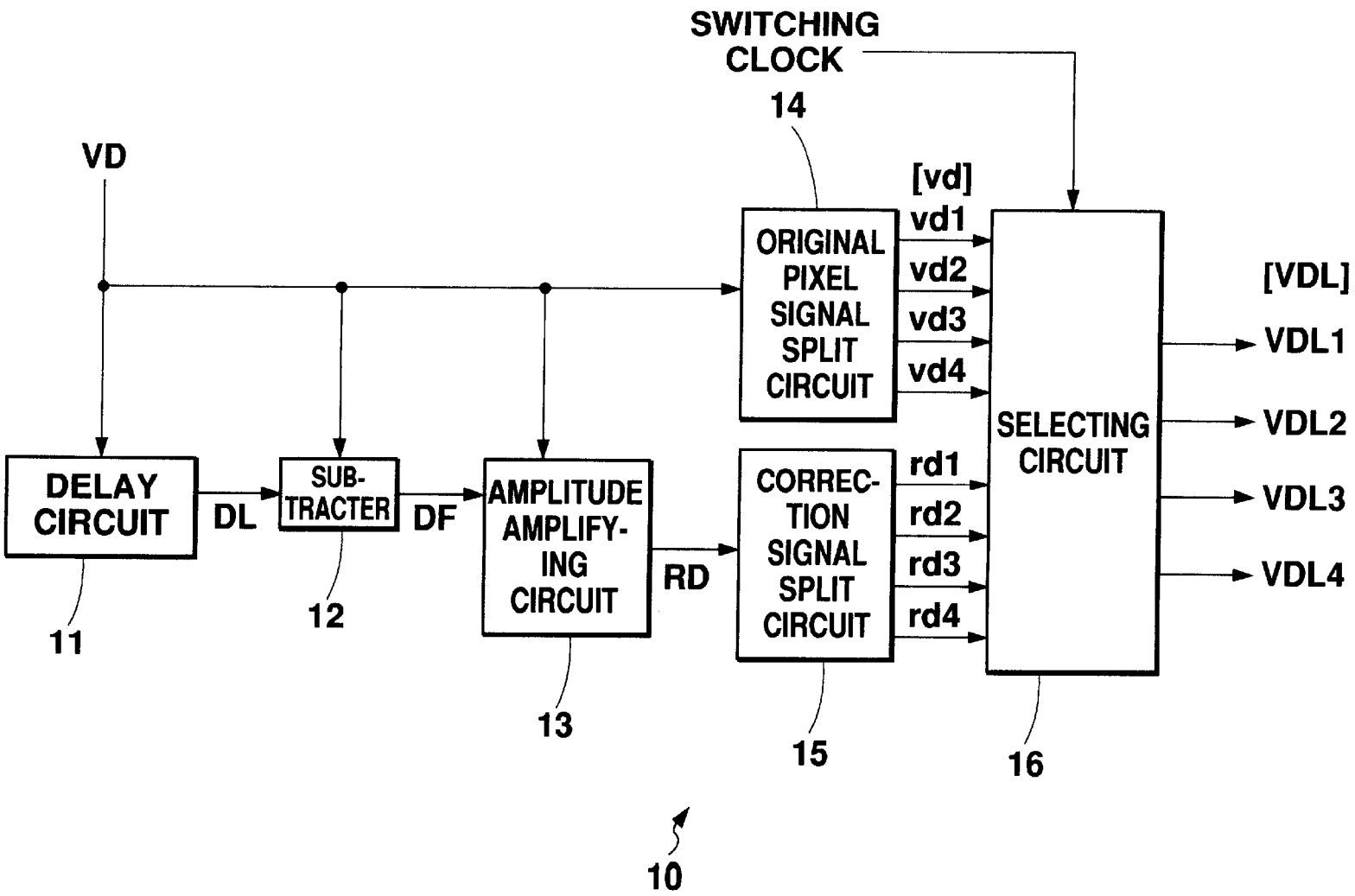
FIG. 10 is a diagram showing a structure of a signal waveform correcting circuit 10 according to a second embodiment of the present invention.

While the overall structure of an LCD driving circuit according to a second embodiment is the same as in FIG. 4, a signal waveform correcting circuit 10 has the following structure and performs the following correction. FIG. 10 shows a structure of the signal waveform correcting circuit 10 according to the second embodiment.

The signal waveform correcting circuit 10 comprises a delay circuit 11, a subtracter 12, an amplitude amplifying circuit 13, an original pixel signal split circuit 14, a correction signal split circuit 15, and a selecting circuit 16. The delay circuit 11 delays an original pixel signal VD by m pixel periods corresponding to a split number m for the original pixel signal VD, for example, 4 pixel periods. A delay signal DL thus obtained is subjected to subtraction with the original pixel signal VD by the subtracter 12.

The amplitude amplifying circuit 13 amplifies or attenuates an amplitude of the original pixel signal VD with an amplification ratio corresponding to an amplitude of a difference signal DF obtained by the subtraction, and outputs a correction signal RD. The original pixel signal split circuit 14 splits the original pixel signal VD every four pixels, and generates four split original pixel signals vd 1, vd 2, vd 3 and vd 4, each having a quarter of the frequency of the original pixel signal VD having display information every four pixels.

The correction signal split circuit 15 generates the same four split correction signals rd 1, rd 2, rd 3 and rd 4 as the original pixel signal VD from the correction signal RD output from the amplitude amplifying circuit 13.

The four split original pixel signals vd 1, vd 2, vd 3 and vd 4 and the four split correction signals rd 1, rd 2, rd 3 and rd 4 are sent to the selecting circuit 16, respectively. The selecting circuit 16 switches, selects and outputs the corresponding split original pixel signals and split correction signals in phase (vd 1 and rd 1, vd 2 and rd 2, vd 3 and rd 3, vd 4 and rd 4) on the basis of a pixel clock or a dividing clock. Consequently, four split correction original pixel signals VDL 1 to VDL 4 having amplified amplitudes are output from the selecting circuit 16 during a part of one period of the split original pixel signal.

The signal waveform correcting circuit 10 according to the second embodiment can be employed in an LCD using plural split driving and dot by dot driving p-SiTFT, and is provided in the video interface circuit 31 shown in FIG. 4 and serves to split each video signal for R, G and B into four sequences in the same manner and to correct a waveform of it.

Figure 11:
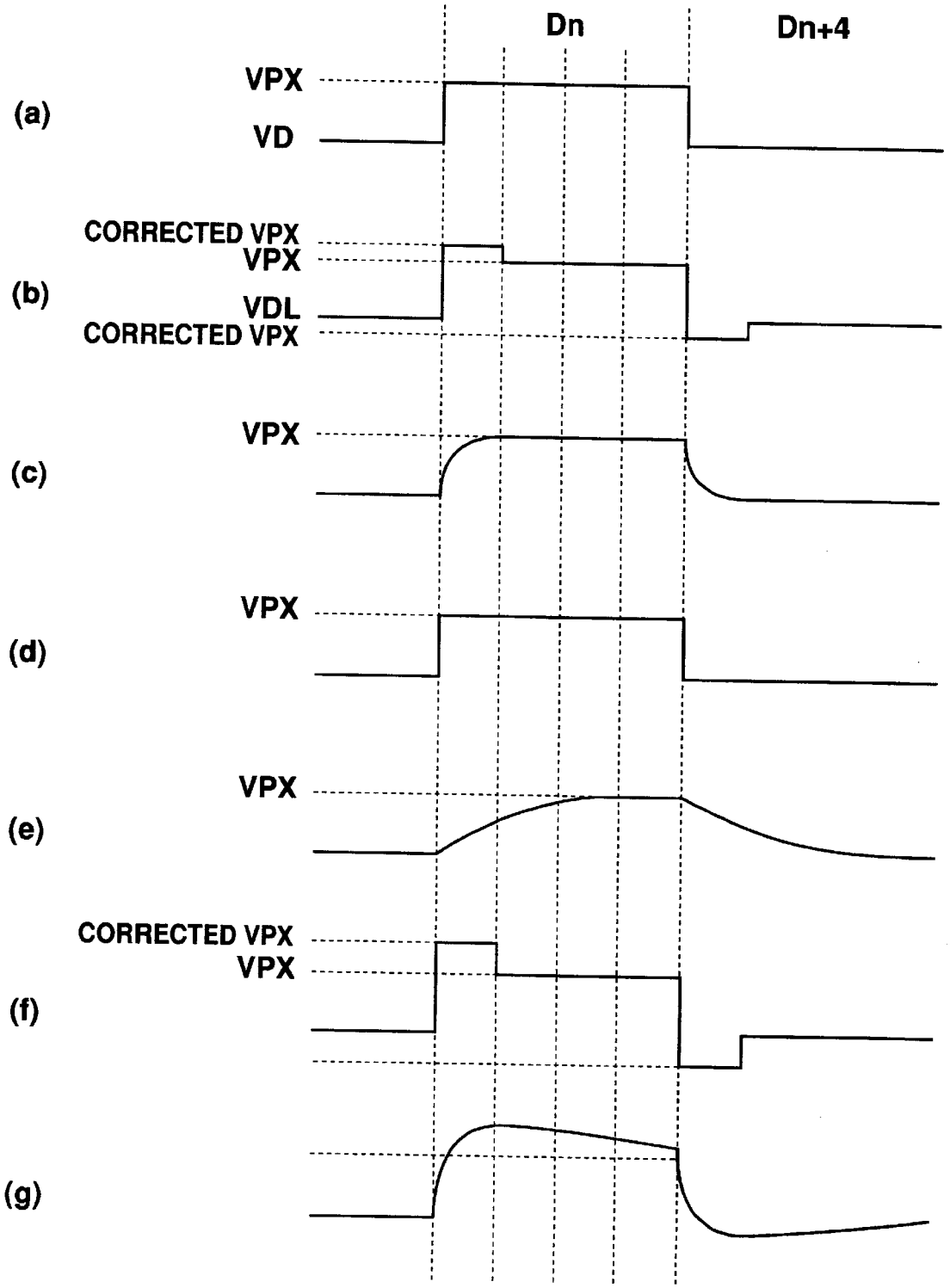
FIG. 11 is waveform diagram showing a comparison between signal waveforms obtained when a split original pixel signal is not corrected and when the split original pixel signal is corrected in the case where a change in the split original pixel signal is small.

FIG. 11 shows signal waveforms obtained when the waveform is corrected and when the waveform is not corrected by the signal waveform correcting circuit 10 according to the second embodiment, and actual output waveforms. FIG. 11 shows a signal waveform which is applied to the video data line [VDL] 62 in the drain driver 36 and a signal waveform which is actually applied to the drain driver 36 in the case where variations are comparatively small before and after rising and falling edges of a split original pixel signal to be sent to the drain driver 36.

FIG. 11(*a*) shows a waveform of a split original pixel signal vd split into four sequences by the original pixel signal split circuit 14, and FIG. 11(*b*) shows a split correction original pixel signal VDL output from the selecting circuit 16, that is, a signal obtained by correction according to the second embodiment. FIG. 11(*c*) shows an output waveform obtained by delaying, in the drain driver 36, the split correction original pixel signal VDL actually output thereto. FIG. 11(*d*) shows a waveform of the split original pixel signal obtained when a waveform is not corrected as in the prior art, and FIG. 11(*e*) shows an actual output waveform of the original pixel signal which is not corrected. Furthermore, FIG. 11(*f*) shows a waveform obtained when the split original pixel signal vd is corrected by a constant quantity, and FIG. 11(*g*) shows an actual output waveform of FIG. 11(*f*).

In the second embodiment, an edge portion of the split original pixel signal vd is corrected to have a suitable correction level VPX corresponding to change obtained before and after the edge portion of the split original pixel signal vd (a difference signal DF in the second embodiment). Accordingly, even if a signal delay is caused in the signal path, the actual output waveform has a very small signal distortion as shown in FIG. 11(*c*), and a voltage level of the waveform is reached to an object voltage level VPX shortly after the start of a 4-pixel period, that is, a Dn period.

In the same manner as in FIG. 8, the split original pixel signal shown in FIG. 11 has small change before and after rising and falling portions. Therefore, even if the original pixel signal is not corrected as shown in FIGS. 11(*d*) and 11(*e*), the original pixel signal is split to set a frequency low so that the signal distortion caused by the signal delay can be recovered at the end of a sampling period.

In the case where the correction quantity is fixed as shown in FIGS. 11(*f*) and 11(*g*), the correction quantity is excessive and affects a voltage level of a subsequent split original pixel signal if the change obtained before and after the edge portion of the split original pixel signal is small in the same manner as in FIGS. 8(*f*) and 8(*g*).

Figure 12:
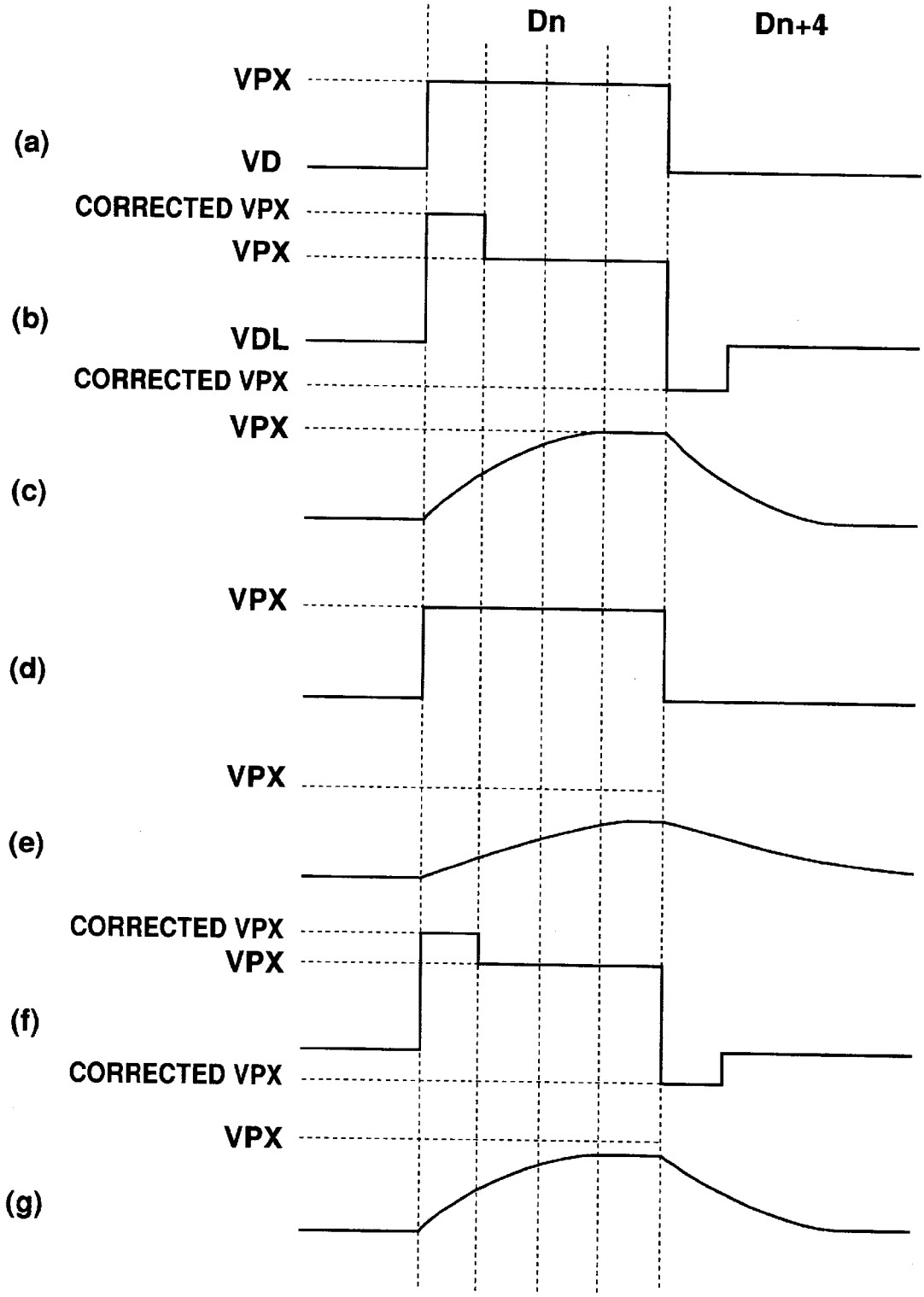
FIG. 12 is waveform diagram showing a comparison between signal waveforms obtained when the split original pixel signal is not corrected and when the split original pixel signal is corrected in the case where the change in the split original pixel signal is great.

FIG. 12 shows each output waveform obtained when the change obtained before and after the rising and falling edges of the split original pixel signal are comparatively great in reverse to FIG. 11. In FIGS. 12(*a*) to 12(*g*), a signal processing method is the same as in FIGS. 11(*a*) to 11(*g*).

In the second embodiment, the edge portion of the split original pixel signal vd is corrected to have a suitable corrected VPX level according to the change obtained before and after the edge portion, that is, the obtained difference signal DF as described above. As shown in FIG. 12(*c*), if the change is greater, the corrected VPX level becomes higher. Therefore, even if the signal delay occurs, the actual output waveform is not affected at the end of the sampling period. If the change is great, the distortion caused by the signal delay cannot be eliminated either at the end of the sampling period when the split original pixel signal vr is not corrected as shown in FIGS. 12(*d*) and 12(*e*). Consequently, quality of display is deteriorated. Furthermore, when the correction quantity is fixed, the correction quantity becomes too small in reverse to FIGS. 11(*f*) and 11(*g*). Consequently, the signal level does not reach the object voltage level VPX even if the end of the sampling period starts. As a result, a voltage of a previous original pixel signal affects a voltage level of a subsequent original pixel signal.

It is apparent from the foregoing that the correction quantity is preferably regulated according to the change in the split original pixel signal on the edge portion also in the case where the split original pixel signal vr and the split correction signal rd are switched to generate the split corrected original pixel signal VDL.

THIRD EMBODIMENT

Figure 13:
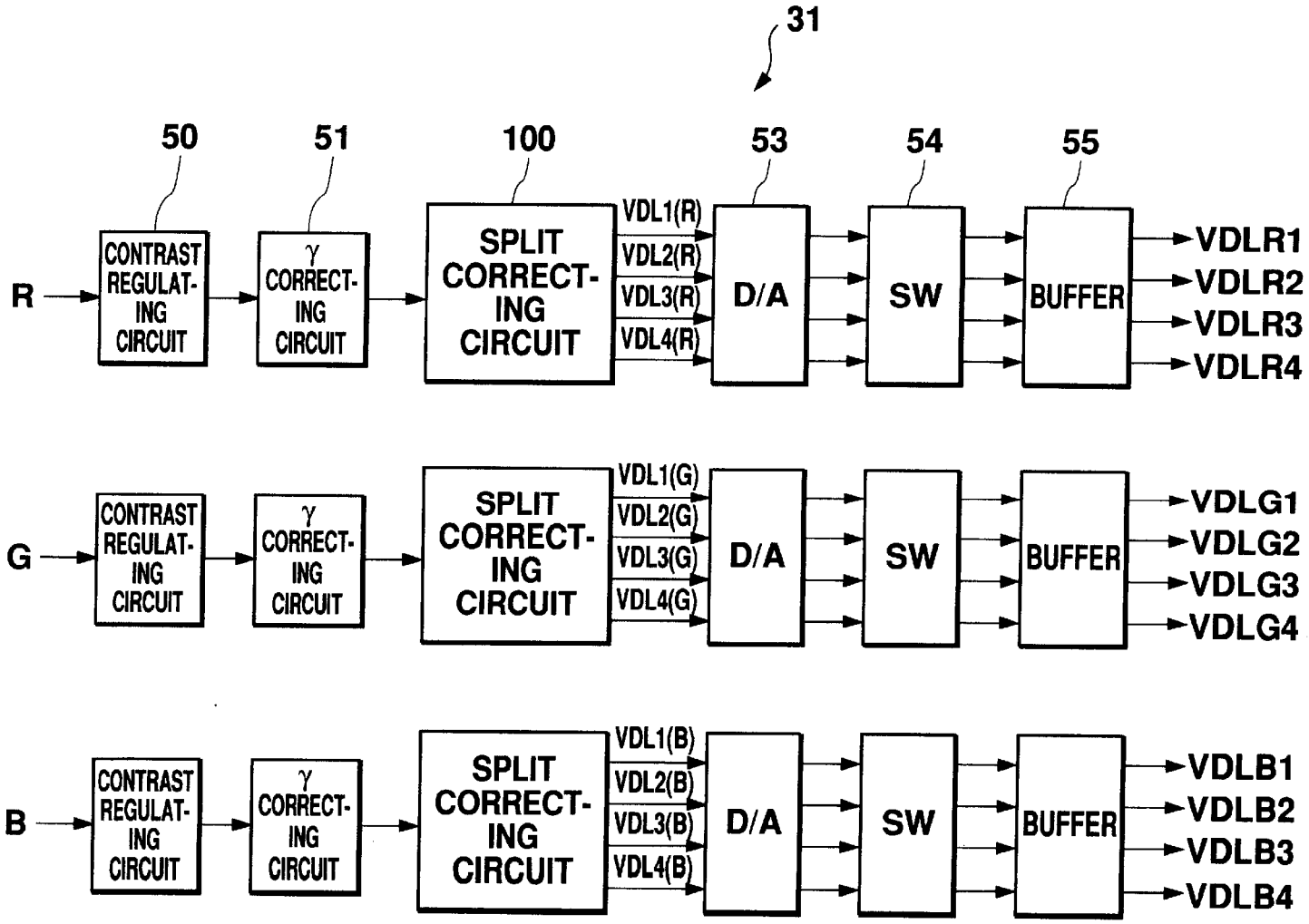
FIG. 13 is a diagram showing a structure of a signal processing circuit of an LCD driving circuit according to a third embodiment of the present invention.

A more specific example of the structure of a signal processing section according to a third embodiment will be described below, in which the second embodiment is applied to an LCD using a p-SiTFT. FIG. 13 shows an example of the structure according to the third embodiment. The structure shown in FIG. 13 includes a path from the video interface circuit 31 to the drain driver 36 through the buffer circuit 32 shown in FIG. 4 in an LCD driving circuit. The case will be described in which each circuit shown in FIG. 13 is provided in the video interface circuit 31 shown in FIG. 4. In the third embodiment, the buffer circuit 32 shown in FIG. 4 is provided as a buffer circuit 55 in the video interface circuit 31.

Original pixel signals for color-decoded R, G and B are sent to an original pixel signal split—waveform correcting circuit (hereinafter referred to as a split correcting circuit) 100, through a contrast regulating circuit 50 and a γ-correcting circuit 51, which is a feature of the third embodiment and corresponds to the signal waveform correcting circuit 10 according to the second embodiment, respectively.

The split correcting circuit 100 splits each of the original pixel signals for R, G and B into m sequences, and generates split original pixel signals, each having a quarter of the frequency of an original pixel signal every m pixel periods, that is, every four pixel periods (m=4). Furthermore, split corrected original pixel signals VDL 1 to VDL 4 for R, G and B which have edge portions of the split original pixel signals properly corrected are generated from the split original pixel signals and corresponding split correction signals generated separately. The specific structure and operation of the split correcting circuit 100 will be described below.

The four split corrected original pixel signals VDL 1 to VDL 4 output as digital signals from the split correcting circuit 100 are converted into analog signals in an analog-to-digital converter (D/A) 53. Furthermore, polarity alignment (inversion) for a pixel by pixel inversion driving operation is performed by an analog switching circuit 54. An output of the analog switching circuit 54 is changed into a predetermined current quantity necessary for driving each pixel in the buffer circuit 55, and are sent to the drain driver 36 as split corrected original pixel signals VDLR 1 to VDLR 4, VDLG 1 to VDLG 4, and VDLB 1 to VDLB 4 for R, G and B.

Figure 14:
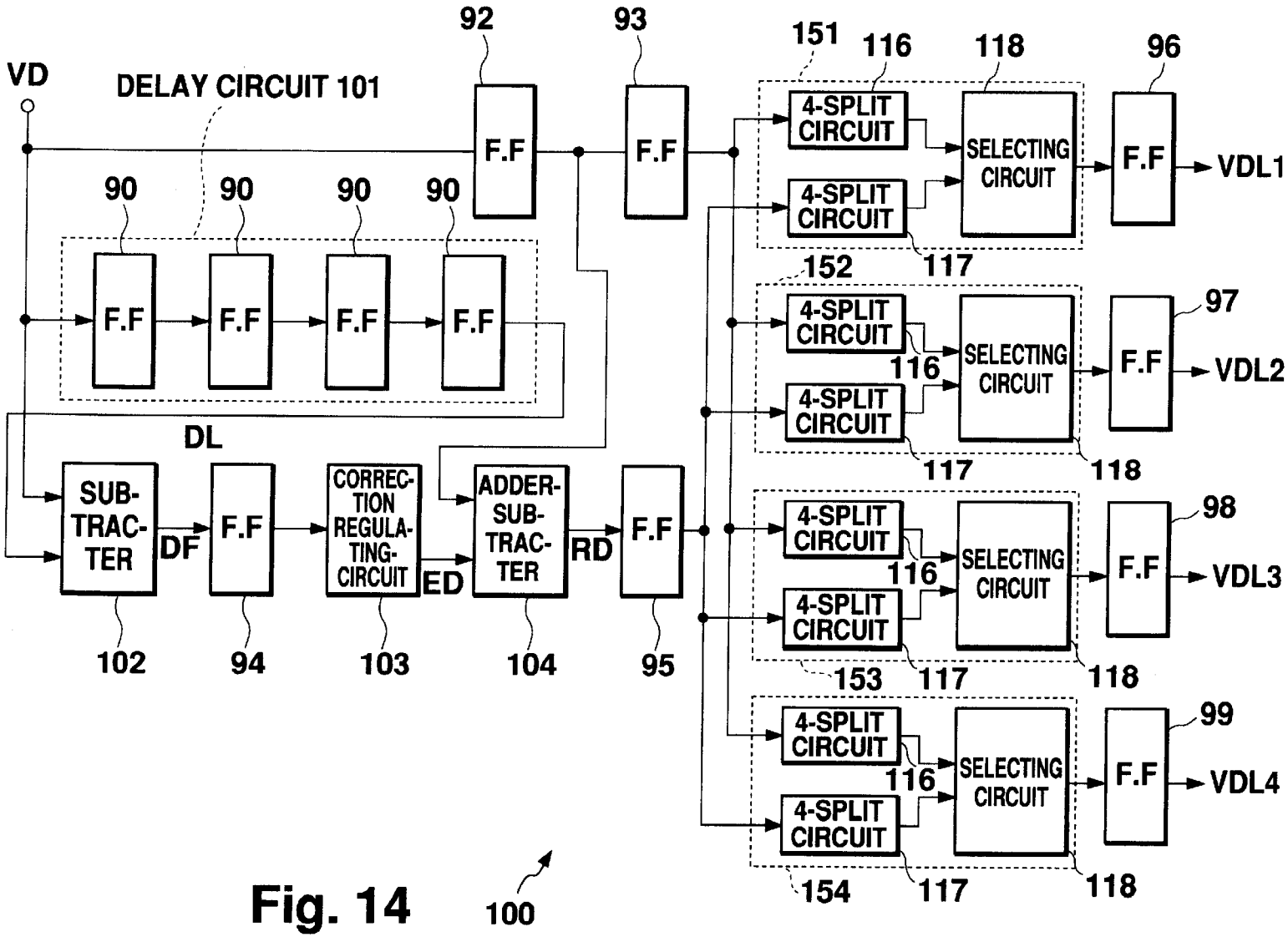
FIG. 14 is a diagram showing a structure of a split correcting circuit 100 in FIG. 13.

FIG. 14 is a block diagram showing the split correcting circuit 100 in FIG. 13. The split correcting circuit 100 has the same structure for R, G and B.

The split correcting circuit 100 comprises a delay circuit 101, a subtracter 102, a correction regulating circuit 103, an adder—subtracter 104, split signal generators 151, 152, 153 and 154, and flip-flops (FFs) 92 to 99.

Each of the split signal generators 151 to 154 includes an original pixel signal split circuit 116 for splitting an original pixel signal VD, a correction signal split circuit 117 for splitting a correction signal RD, and a selecting circuit 118 for selecting and outputting signals sent from the split circuits 116 and 117 by switching.

The original pixel signal VD is delayed by four pixel periods in the delay circuit 101 having four flip-flops 90, and is sent to the subtracter 102. The subtracter 102 takes a difference between the original pixel signal VD and a delay signal DL which is obtained by four pixel periods before and is sent from the delay circuit 101. A difference signal DF thus obtained is sent to the correction regulating circuit 103 through the flip-flop 94. The correction regulating circuit 103 has a structure in which correcting data are prestored in a ROM, a read address of the ROM is controlled in response to the difference signal DF output from the subtracter 102, and correcting data ED corresponding to the difference is output. The correcting data ED is sent to the adder—subtracter 104.

The original pixel signal VD having a timing adapted to the correcting data ED is sent to the adder—subtracter 104 through the FF 92. The adder—subtracter 104 adds or subtracts the correcting data ED to or from the original pixel signal VD based on a polarity thereof, thereby generating a correction signal RD obtained by amplifying or attenuating an amplitude of the original pixel signal VD.

The original pixel signal VD output from the FF 92 is sent to the FF 93, and the correction signal RD output from the adder—subtracter 104 is sent to the FF 95. The original pixel signal VD and the correction signal RD output from the FFs 93 and 95 are synchronized with each other. In a synchronized state , the original pixel signal VD and the correction signal RD are sent to the four split signal generators 151 to 154, respectively. In the split signal generators 151 to 154, the original pixel signal split circuit 116 splits and expands the sent original pixel signal VD into four sequences to generate a split original pixel signal in a 4-pixel period, and the correction signal split circuit 117 splits and expands the correction signal RD into four sequences to generate a split correction signal in a 4-pixel period. The selecting circuit 118 selects outputs of the split circuits 116 and 117 by switching. Consequently, split correction original pixel signals VDL 1 to VDL 4 are generated and are output through the FFs 96, 97, 98 and 99, respectively.

Figure 15:
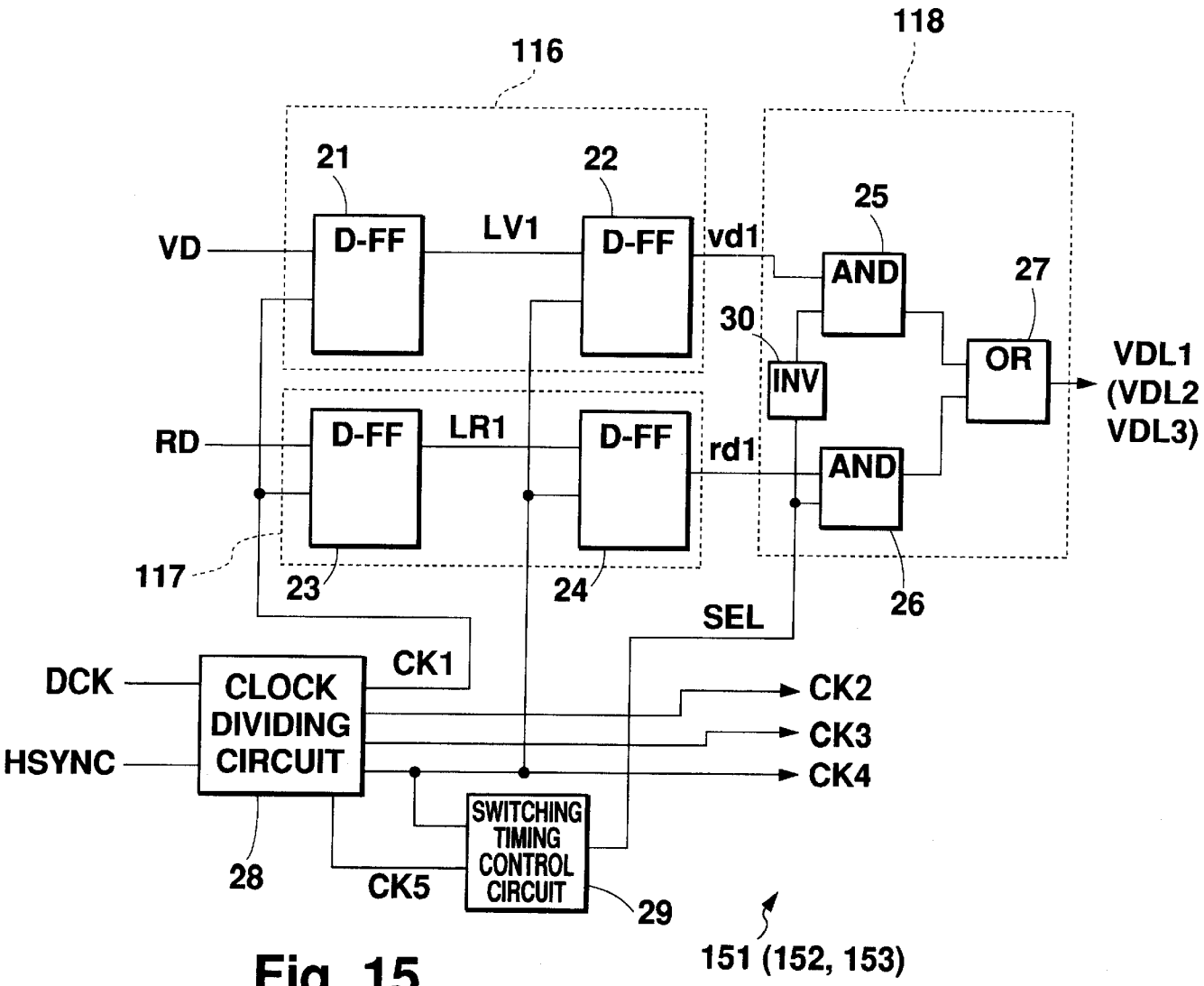
FIG. 15 is a diagram showing a structure of each of split signal generators 151, 152 and 153.

FIG. 15 is a more detailed block diagram showing the split signal generator 151 shown in FIG. 14. The split signal generator 151 comprises two D—FFs 21 and 22 which construct the original pixel signal split circuit 116, two D-type—FFs 23 and 24 which construct the correction signal split circuit 117, and two AND circuits 25 and 26 and an OR circuit 27 which construct the selecting circuit 118.

A clock dividing circuit 28 receives a horizontal synchronizing pulse HSYNC and a dot clock DCK to divide the dot clock DCK to have a ¼ frequency, and generates ¼ duty cycle clocks CK 1, 2, 3 and 4 whose phases are different from each other by 90°.

The three split signal generators 151, 152 and 153 shown in FIG. 14 have the same structures as in FIG. 15. As shown in FIG. 15, the clocks CK 1 and CK 4 are sent from the clock dividing circuit 28 to the first split signal generator 151. More specifically, the clock CK 1 is sent to inputs of the clock inputs of the D-type—FFs 21 and 23, and the clock CK 4 is sent to inputs of the clock inputs of the D—FFs 22 and 24.

The original pixel signal VD is sent to a D input of the D-type—FF 21, a Q output (LV 1) is sent to a D input of the D-type—FF 22, and a Q output (vd 1) is sent to one of input ends of the AND circuit 25. The correction signal RD is sent to a D input of the D-type—FF 23, and a Q output (LR 1) is sent to a D input of the D-type—FF 24, and a Q output (rd 1) is sent to one of input ends of the AND circuit 26.

A selection clock SEL and an inverted clock are sent to the other input end of each of the AND circuits 25 and 26. The clock CK 4 is used as the selection clock SEL. Inverted and non-inverted clocks of the clock CK 4 are sent to the AND circuits 25 and 26, respectively. Outputs of the AND circuits 25 and 26 are sent to the OR circuit 27, and are output as a split and shaped corrected original pixel signal VDL 1.

In the second and third split signal generators 152 and 153, the clocks CK 2 and CK 3 having different phases are sent to first latches 21 and 23 in place of the clock CK 1, and split corrected original pixel signals VDL 2 and VDL 3 are generated, respectively.

Figure 16:
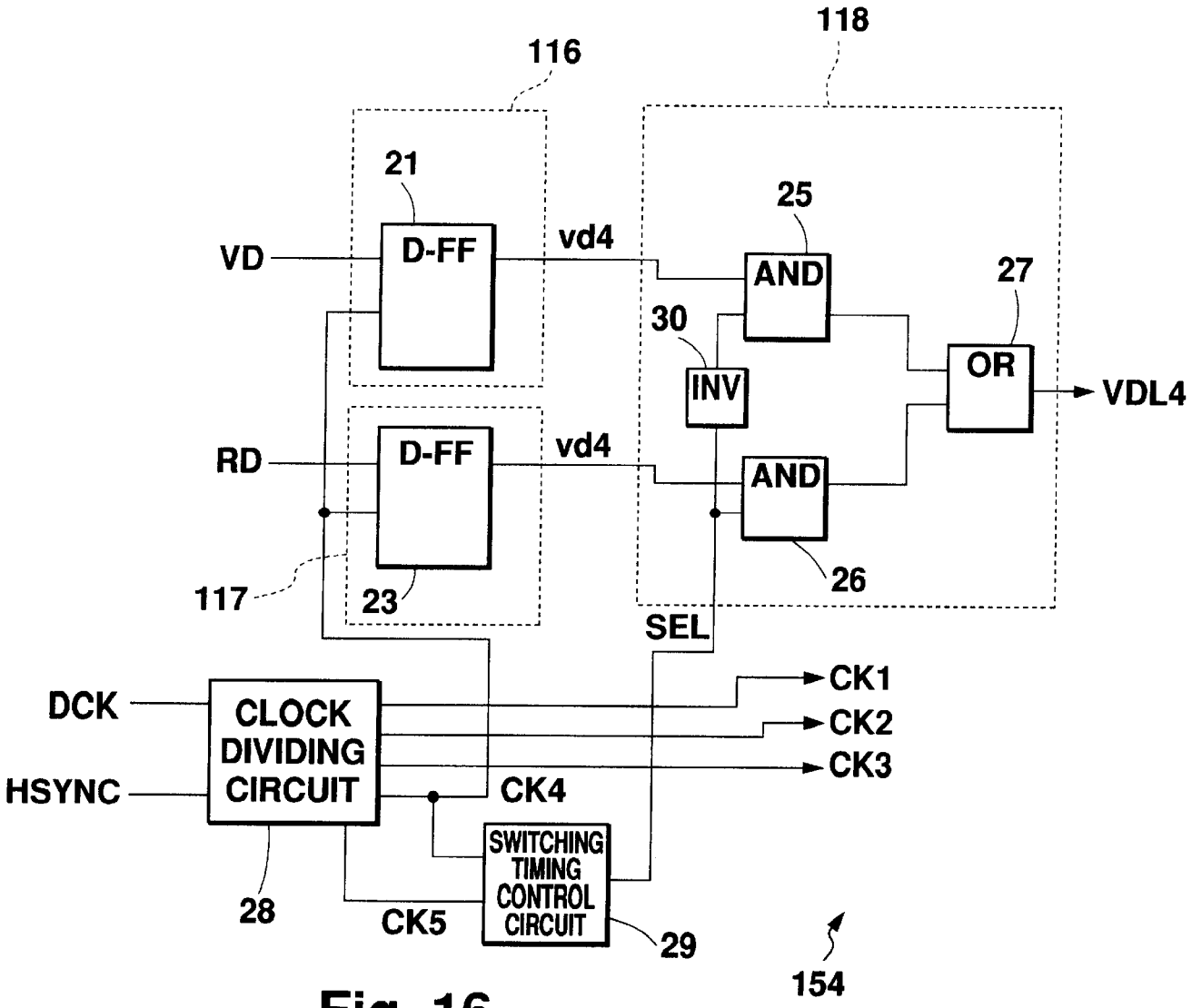
FIG. 16 is a diagram showing a structure of a split signal generator 154.

FIG. 16 is a block diagram showing the split signal generator 154. The split signal generator 154 includes a D-type—FF 21 forming the original pixel signal split circuit 116, a D-type—FF 23 forming the correction signal split circuit 117, and two AND circuits 25 and 26 and an OR circuit 27 which form the selecting circuit 118. The clock CK 4 is input to the D-type—FFs 21 and 23.

The clock dividing circuit 28 and the switching timing control circuit 29 are common to the four split signal generators 151 to 154. Thus, the original pixel signal VD and the correction signal RD are subjected to sample and hold by the clocks CK 1 to CK 4 in the split signal generators 151 to 154. Consequently, the original pixel signal VD and the correction signal RD are split and expanded. By using the clock CK 4 as a samplehold clock, split corrected original pixel signals VDL 1 to VDL 4 having the same phase as that of outputs of other split signal generators are sent from the split signal generators 151 to 154.

Figure 17:
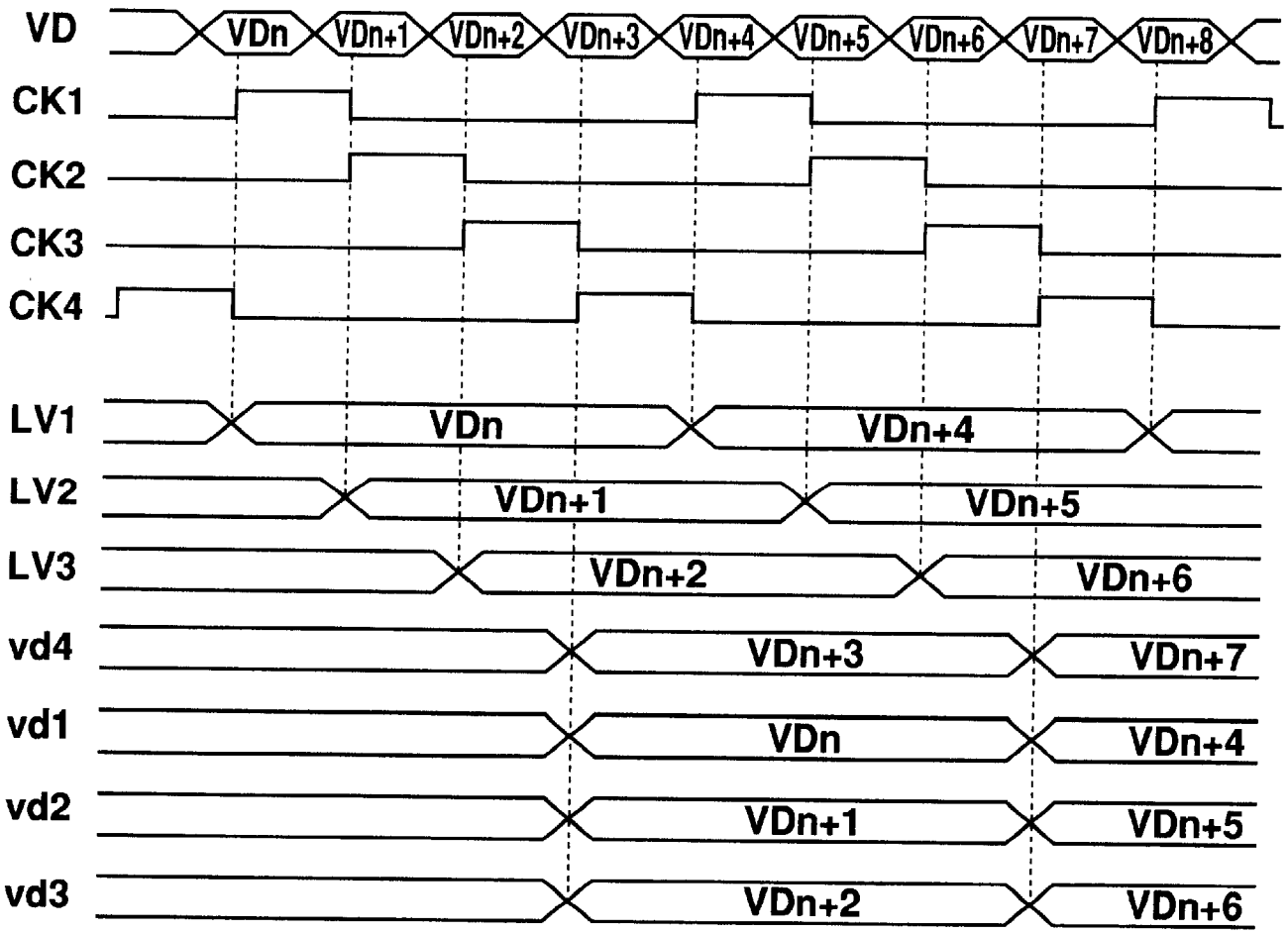
FIGS. 17 and 18 are waveform diagrams showing an operating timing of the split signal generator.
Figure 18:
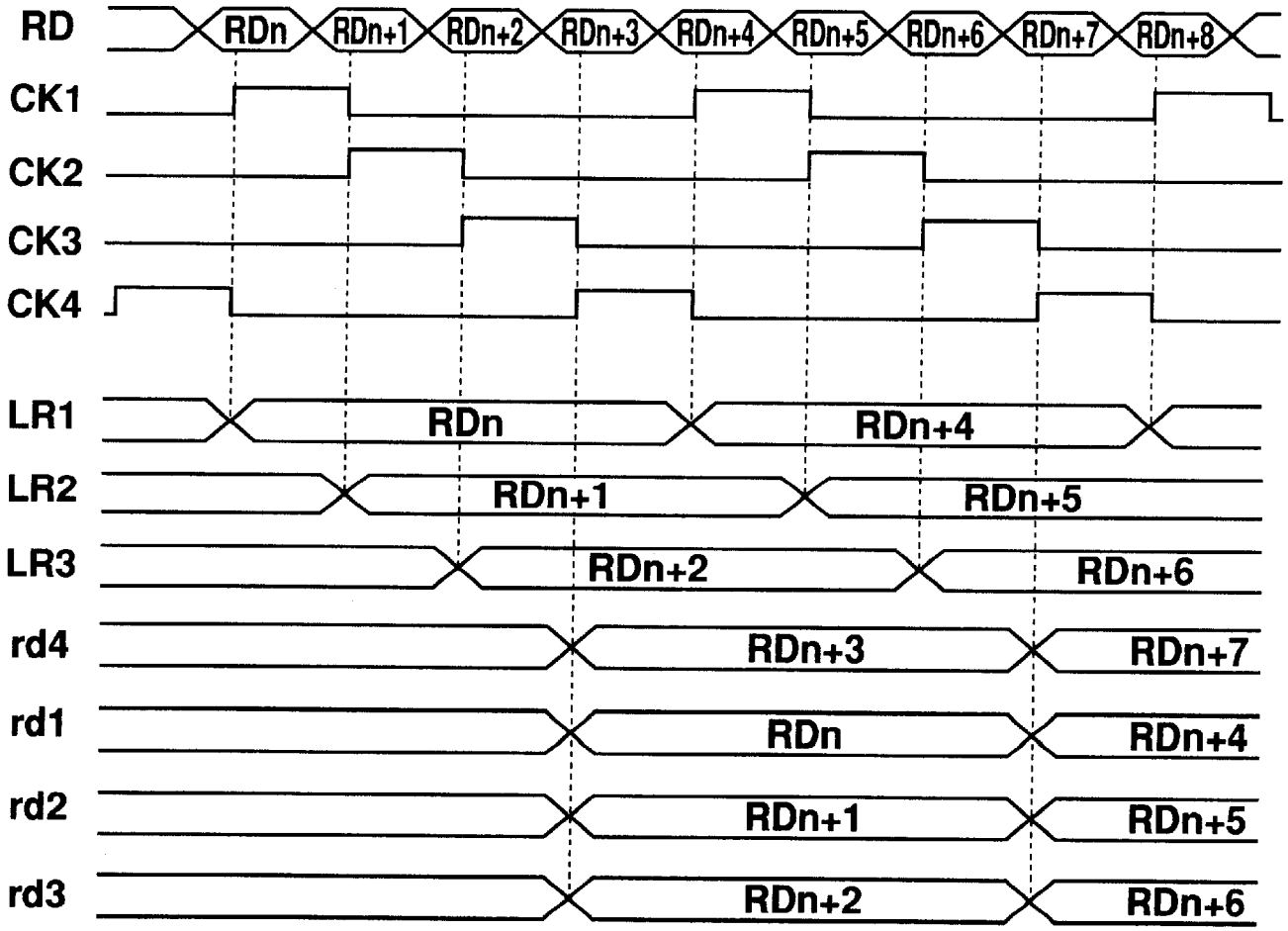
Figure 19:
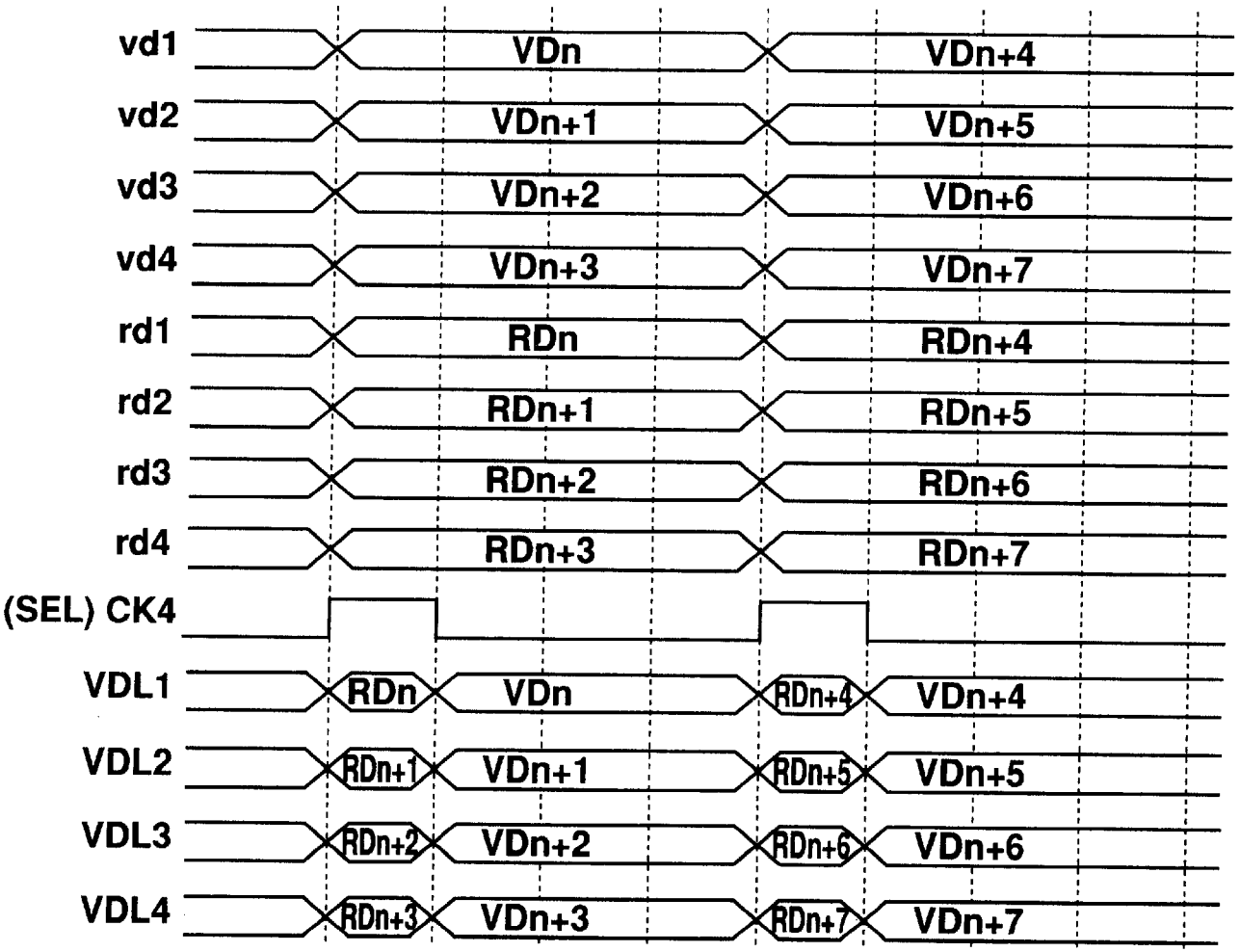
FIG. 19 is a waveform diagram showing an operating timing of a selecting circuit 118.

FIGS. 17 and 18 are timing charts showing a state in which the original pixel signal VD and the correction signal RD are split and expanded in the signal split circuits 116 and 117 having the above-samplehold function. FIG. 19 is a timing chart showing a state in which four split corrected original pixel signals VDL 1, VDL 2, VDL 3 and VDL 4 having waveforms shaped are generated by correction signals rd 1 to rd 4 which are split and expanded in the same manner as the split and expanded original pixel signals vd 1 to vd 4.

Referring to FIGS. 17 and 18, original pixel data VD having pixel data VDn corresponding to each pixel arranged in series on a time basis and corresponding correction signal RDn are fetched every four pixels by the clocks CK 1 to CK 4 in each sequence, and are split and expanded into 4 phases (LV 1, 2, 3, vd 4, LR 1, LR 2, LR3, rd 4) and are further set in phase by the clock CK 4 (vd 1, 2, 3, 4, rd 1, 2, 3, 4). The clock CK 4 has the function of fetching a fourth sequence of the original pixel signal VD and correction signal RD, and making phases coincident with each other (vd 4, rd 4). The split and expanded split original pixel signals vd 1, 2, 3 and 4 and the split correction signals rd 1, 2, 3 and 4 have a cycle for four pixel periods.

In FIG. 19, the AND circuits 25 and 26 shown in FIGS. 15 and 16 perform a switching operation using the selection clock SEL so that first ¼ periods of the split and expanded split original pixel signals vd 1, 2, 3 and 4 are replaced with the correction signals rd 1, 2, 3 and 4 which have been split and expanded in the same manner. In corrected original pixel data VDL 1, 2, 3 and 4 thus obtained, data corresponding to one pixel are split and expanded for four dot periods, and a first one-dot period has a correction signal RDn having an amplitude regulated, and the next three-dot periods have an original pixel signal VDn.

In particular, the corrected original pixel data VDL 1, 2, 3 and 4 are expanded by four times, and an amplitude should be regulated for a ¼ cycle period, that is, an original one pixel period. Therefore, a sample hold clock CK 4 is precisely utilized as the selection clock SEL to perform 1:3 data correction. Consequently, signal processing can be implemented with a comparatively simple structure. For example, 1:1 correction can be performed by switching and selecting a ½ duty cycle clock CK 5 generated by the clock dividing circuit 28 in place of the sampling clock CK 4 in a switching timing control circuit 29 to obtain a selection switching clock SEL.

Each of digital outputs sent from the first to fourth split signal generators 151 to 154 which are thus obtained includes pixel signals every four pixels which are different from each other, has a period which is four times as much as a period of the pixel signal, and is changed into a corrected original pixel signal VDL which has been optimally corrected. The 4-sequence corrected original pixel signals VDL 1 to VDL 4 are generated for R, G and B in the same manner, respectively.

FOURTH EMBODIMENT

Figure 20:
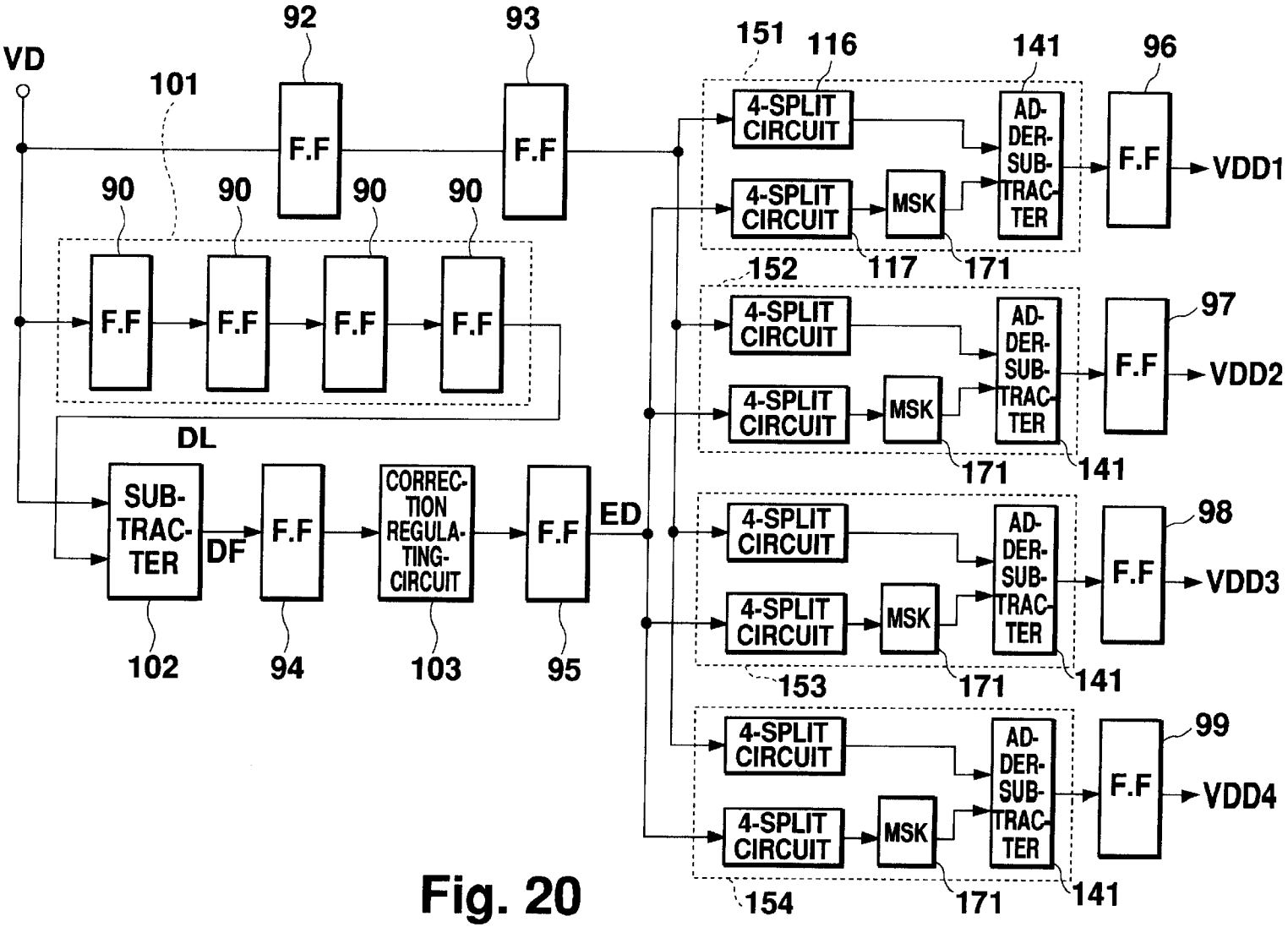
FIG. 20 is a diagram showing a structure of a split correcting circuit 100 according to a fourth embodiment of the present invention.

In a fourth embodiment, a split correcting circuit 100 shown in FIG. 20 is used in place of the structure of the split correcting circuit 100 shown in FIG. 14. In the split correcting circuit 100 shown in FIG. 20, a correction regulating circuit 103 creates correcting data ED corresponding to a difference between a current original pixel signal VD and an original pixel signal VD obtained four pixel cycles before in the same manner as in the third embodiment.

In the fourth embodiment, the correcting data ED output from the correction regulating circuit 103 is directly transmitted as a correction signal to second samplehold circuits 117 of split signal generators 151, 152, 153 and 154 in the split correcting circuit 100 shown in FIG. 20.

Each of the split signal generators 151, 152, 153 and 154 includes split circuits 116 and 117 forming first and second sample hold circuits, an adder—subtracter 141, and a mask circuit 171 provided between the split circuit 117 and the adder—subtracter 141.

With this structure, the correcting data ED sent to the second split circuit 117 is split and expanded in four sequences together with the original pixel signal VD sent to the first split circuit 116. An amplitude of the split and expanded correcting data ED is eliminated for a predetermined period, for example, excluding a first one pixel period of each split original pixel signal period by the mask circuit 171 controlled with the same selection switching clock SEL as in the third embodiment shown in FIGS. 15 and 16. Consequently, the selecting circuit 118 shown in FIG. 14 is unnecessary. Instead, the correcting data ED is added to or subtracted from the split and expanded original pixel data vd 1, 2, 3 and 4 by using the adder—subtracter 141. As a result of the addition or subtraction, the same split corrected original pixel data VDL 1, 2, 3 and 4 as in the fourth embodiment can be obtained.

FIFTH EMBODIMENT

Figure 21:
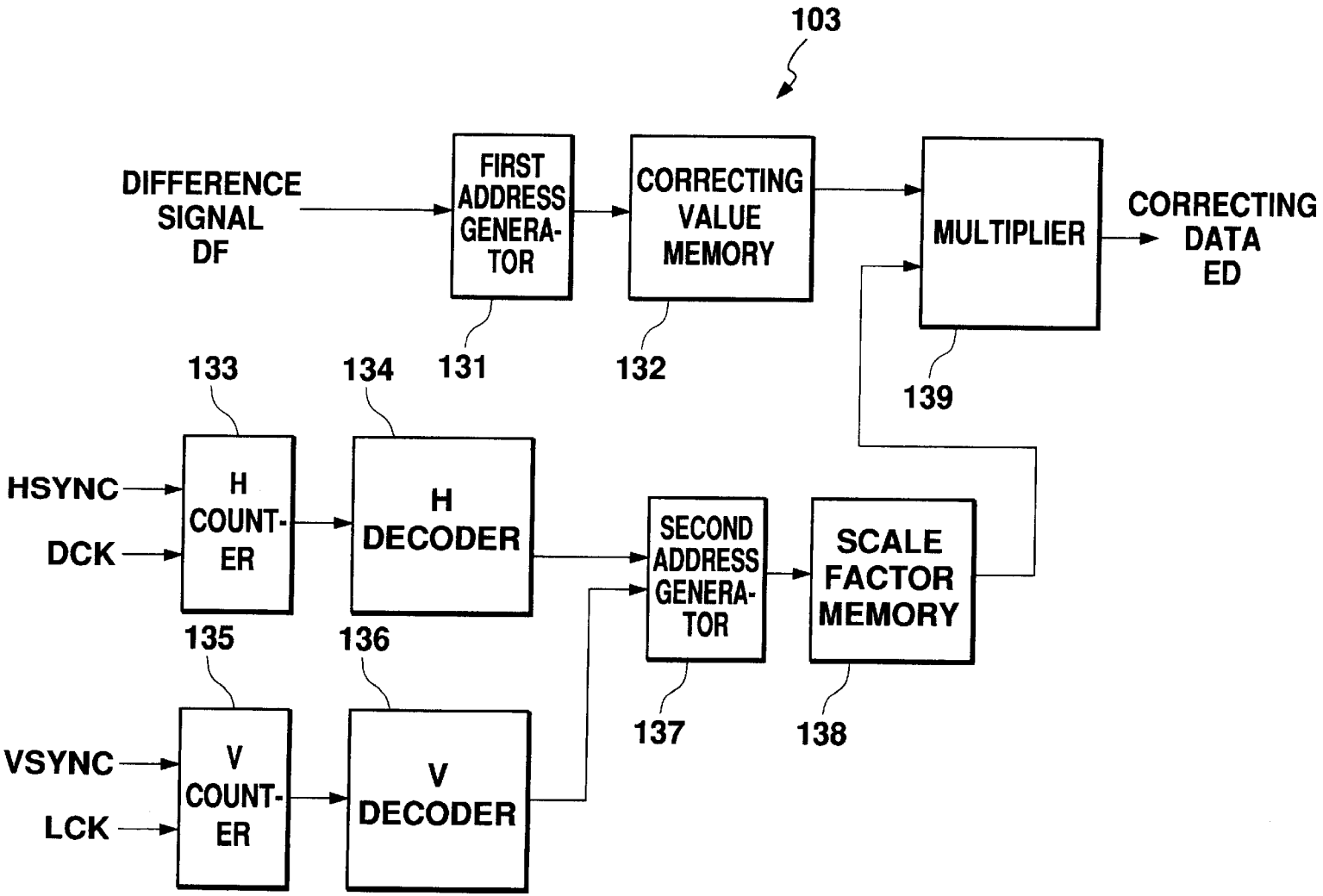
FIG. 21 is a diagram showing a structure of a correction regulating circuit according to a fifth embodiment of the present invention.

In a fifth embodiment, a correction regulating circuit 103 creates correcting data ED corresponding to a difference between a current original pixel signal VD and an original pixel signal VD obtained four pixel cycles before, and positions of pixels arranged in a matrix to which the current original pixel signal VD is to be sent in the split correcting circuit 100 shown in FIGS. 14 or 20. FIG. 21 shows a structure of a correction regulating circuit 103 for creating such correcting data ED according to the fifth embodiment.

The correction regulating circuit 103 according to the fifth embodiment comprises a first address generator 131, a correcting value memory 132, a horizontal counter 133, a horizontal decoder 134, a vertical counter 135, a vertical decoder 136, a multiplier 139 and a scale factor generator. The scale factor generator includes a second address generator 137 and a scale factor memory 138. Difference data DF created by the subtracter 102 is transmitted to the first address generator 131. An address is generated on the basis of the difference data DF. The correcting value memory 132 stores a correcting value which is increased if an absolute value of the difference data DF is increased. More specifically, the correction value is read according to the address generated by the difference data DF, thereby resulting in generation of correcting value data that is increased if a difference between the original pixel signal VD and an original pixel signal VD obtained four pixels before is increased, which will be described below in more detail. The correcting value data is transmitted to the multiplier 139.

A horizontal synchronizing pulse HSYNC and a dot clock DCK are sent to the horizontal counter 133, and a vertical synchronizing pulse VSYNC and a line clock LCK are sent to the vertical counter 135. The horizontal counter 133 counts the dot clocks DCK, and the horizontal decoder 134 supplies column position information of a corresponding pixel of the original pixel signal VD to the second address generator 137 according to the count value. The vertical counter 135 counts line clocks LCK, and the vertical decoder 136 supplies row position information of the corresponding pixel of the original pixel data VD to the second address generator 137 according to the count value.

The second address generator 137 generates an address on the basis of matrix position information, and reads scale factor data from the scale factor memory 138. While the scale factor memory 138 is a ROM storing scale factor values in a matrix, for example, it stores scale factor values corresponding to a distortion of a signal of an LCD panel in a matrix position.

As shown in FIG. 4, the LCD panel has a layout in which the gate driver 35 is provided on the left of the display section 34 and the drain driver 36 is provided above the display section 34 on a paper of FIG. 4. Therefore, the scale factor values stored in the ROM are set greater on the right side than the left side of a pixel matrix position in the display section 34. Furthermore, the scale factor values are set greater on the lower side than on the upper side of the pixel matrix position. The reason for this is that an applied signal causes a greater delay and distortion as a pixel position becomes more distant from the drivers 35 and 36. If importance is attached to the cost of a circuit, only predetermined high order bits of outputs of the horizontal and vertical counters 133 and 135 can be decoded to split the LCD panel into several regions, and the same scale factor value can be given to reduce matrix position information in the same split regions. Consequently, a scale factor corresponding to a variation in a signal distortion in each region of an LCD is specified. Scale factor value data are transmitted to the multiplier 139 and are multiplied by correcting value data created by the correcting value generators (137 and 138) so that amplitude regulation data (correcting data) ED is created. The amplitude regulation data ED is transmitted to the adder—subtracter 14. If the relationship between the drivers 35 and 36 and the display section 34 in the panel is different from that of FIG. 4, for example, the drain driver 36 is provided on the lower side, the scale factor value is set greater in a higher pixel position. If the gate driver 35 is provided on the right side, the scale factor value is set greater toward a left pixel position.

Figure 22:
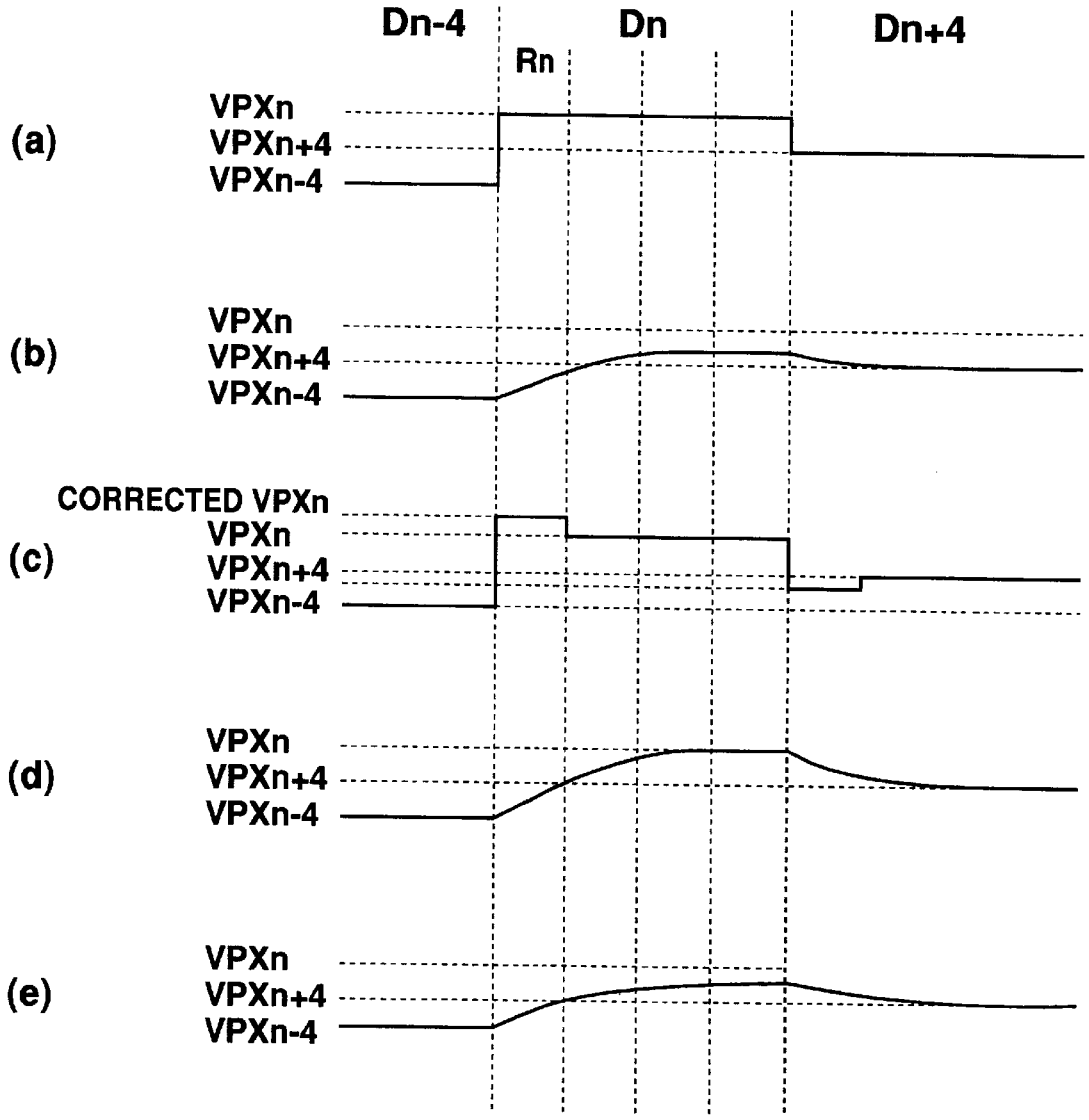
FIGS. 22 and 23 are waveform diagrams for explaining a correcting method to be performed by the correction regulating circuit according to the fifth embodiment, and a correction signal.
Figure 23:
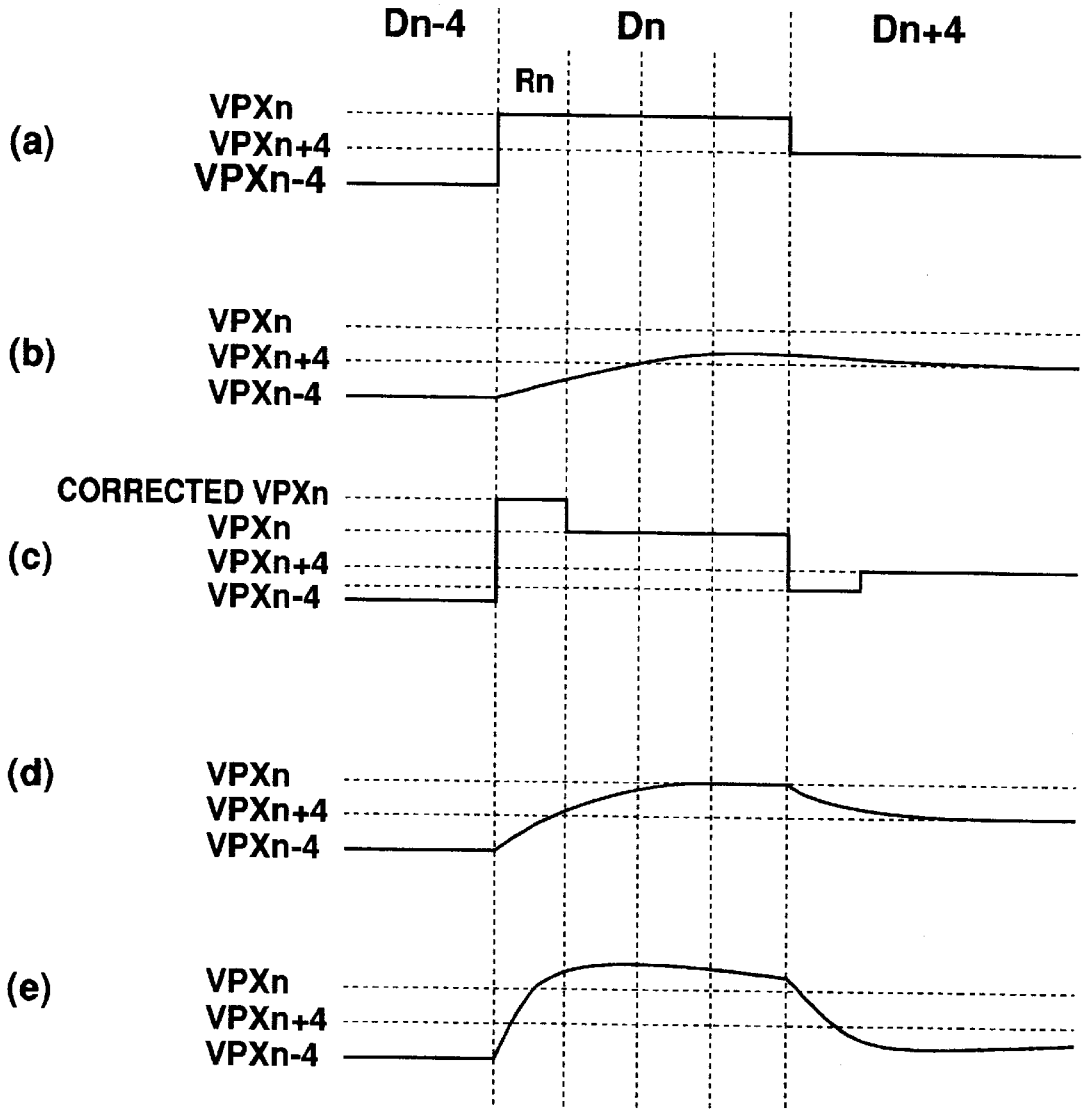

FIGS. 22 and 23 are waveform diagrams for comparing original pixel signals to be sent to the drain driver 36. FIGS. 22(*a*) and 23(*a*) show a conventional signal waveform of the original pixel signal which is not processed immediately before it is sent to the drain driver 36, and FIGS. 22(*b*) and 23(*b*) show a waveform of the original pixel signal which is obtained when the non-corrected signal is actually sent to a display pixel. FIGS. 22(*c*) and 23(*c*) show a waveform of the split corrected original pixel signal VDL split and corrected according to the fifth embodiment which is obtained immediately before it is sent to the drain driver 36, FIGS. 22(*d*) and 23(*d*) show a waveform of an original pixel signal which is actually sent to each display pixel, and FIGS. 22(*e*) and 23(*e*) show a signal waveform obtained when the same original pixel signal is sent to display pixels in other matrix positions. FIG. 22(*c*) shows the case where a correction quantity is adapted to a display pixel in a comparatively upper left matrix position of the LCD display section 34 shown in FIG. 4, and FIG. 23(*c*) shows the case where the correction quantity is adapted to a display pixel in a comparatively lower right matrix position. FIGS. 22(*e*) and 23(*e*) show comparative examples. FIGS. 22(*e*) and 23(*e*) show a signal waveform obtained when the same corrected original pixel signal (FIGS. 22(*c*) and 23(*c*)) is sent to the display pixels in the comparatively lower right matrix position and the comparatively upper left matrix position.

Figure 2:
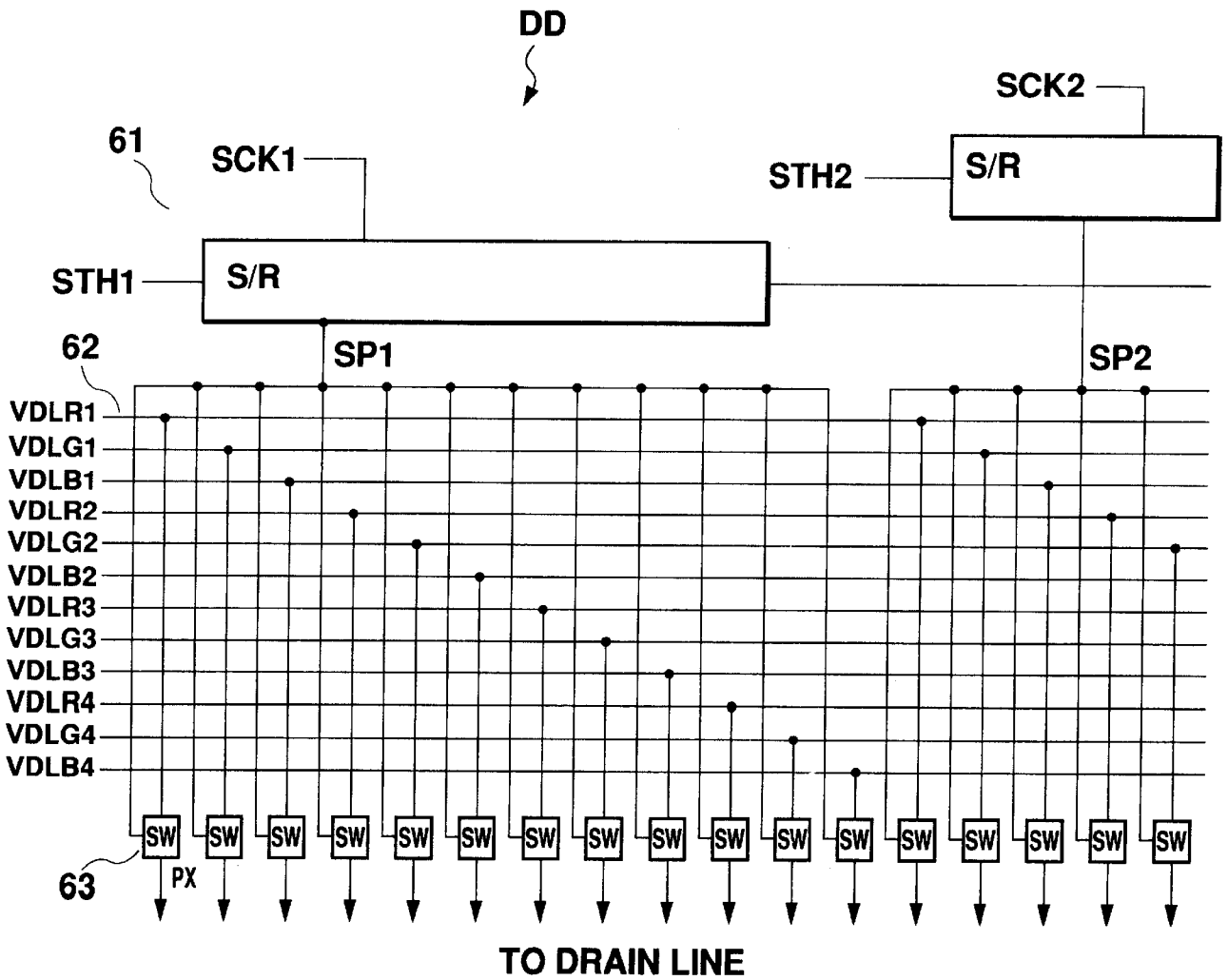
Fig. 2 PRIOR ART
FIG. 2 is a diagram showing a structure of a drain driver according to the prior art.
Figure 3:
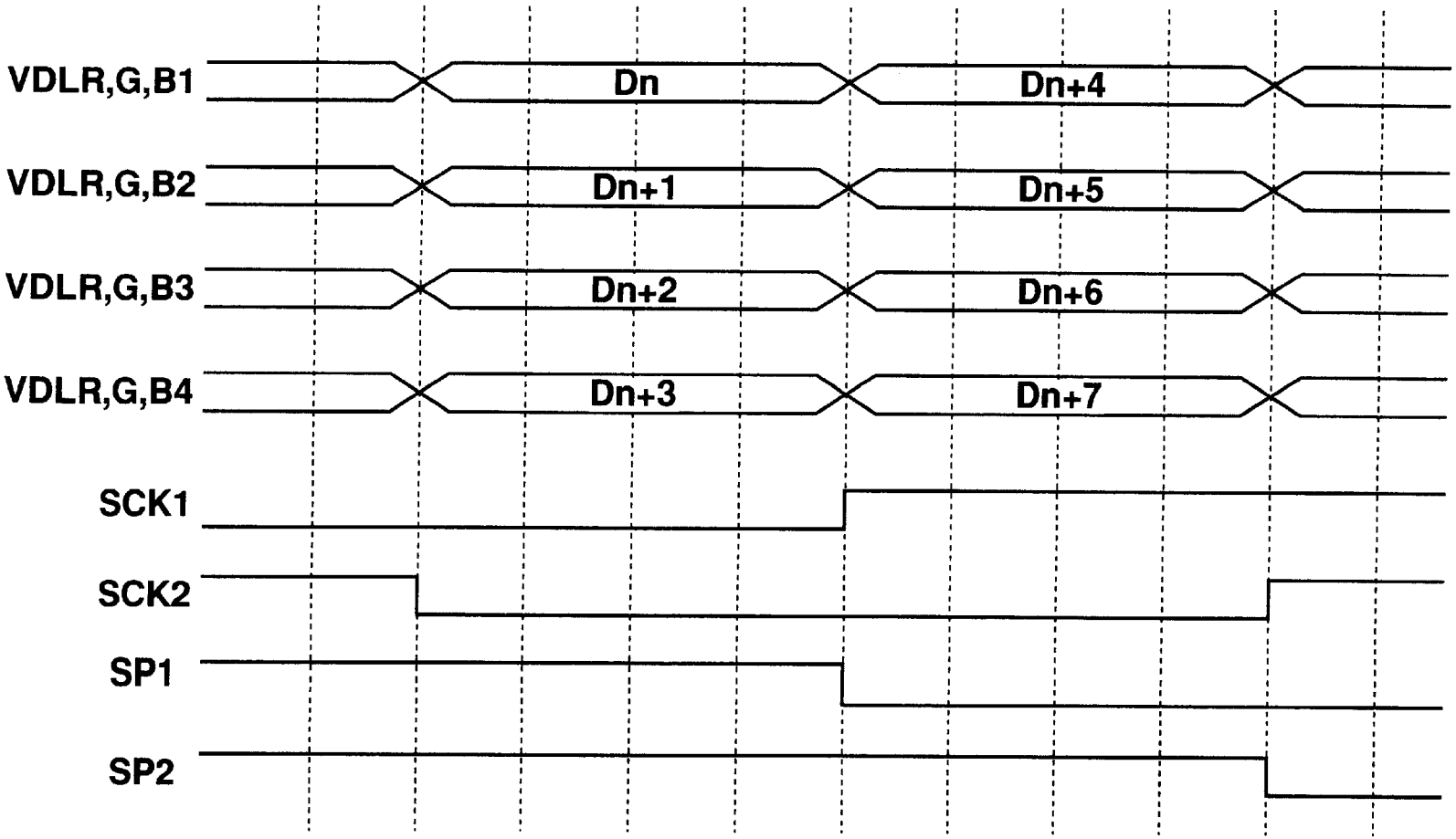
Fig. 3 PRIOR ART
FIG. 3 is a waveform diagram for explaining the relationship between original pixel data in the drain driver of FIG. 2 and shift clocks of shift registers.

A conventional original pixel signal shown in FIG. 22(*a*) or 23(*a*) is D/A converted in the buffer circuit 32 shown in FIG. 1, and is then distorted during amplification or due to a capacitive load of the video data line 62 in the drain driver 36 shown in FIG. 2, an ON-state resistance of the sampling switch 63 formedbyap-SiTFT or the like. Furthermore, the signal distortion is also caused by a capacitive load in the drain line DL. Accordingly, the original pixel signal which is not corrected as in the prior art is considerably distorted. Consequently, the original pixel signal to be actually sent to the display pixel has the waveform shown in FIGS. 22(*b*) or 23(*b*). For this reason, the sampled pixel signal does not reach an object voltage value VPX. A distortion of the signal in FIG. 23(*b*) is greater than that in FIG. 22(*b*).

In the fifth embodiment, correction is performed for a beginning predetermined period of data Dn corresponding to a pixel according to a difference between the data Dn and data Dn−4corresponding to a previous pixel in the same sequence and a matrix position of the pixel so that an amplitude is regulated at a digital processing step as shown in FIGS. 22(*c*) or 23(*c*). Thus, convex waveform shaping is performed so that a waveform has a highlighted edge which is formed with the previous data. Referring to the correction according to the difference between the data, a correction quantity is set larger and an amplitude of a waveform in a corrected portion is large when the data Dn is greater than the previous data Dn−4, and the correction quantity is set smaller and the amplitude of the waveform in the corrected portion is small when the data Dn is smaller than the previous data Dn−4 as shown in FIGS. 22(*c*) and 23(*c*) in the fifth embodiment. Such a correction quantity is increased by the correcting value generators 131 and 132 shown in FIG. 21 as the difference between the data Dn and the previous data Dn−4 is increased. Thus, if a change in data between pixels is greater, an amplification or attenuation width of an amplitude is increased. Consequently, a signal distortion can be relaxed to absorb the corrected portion, that is, a convex portion as shown in FIGS. 22(*d*) or 23(*d*), and a object voltage value VPX can be reached at a final sampling point of each pixel period.

Furthermore, the signal distortion depends on a matrix position in the LCD panel even if the change between the current data and the previous data is equal. For example, the distortion of the original pixel signal is increased in a position which is more distant from an input end of the original pixel signal in the drain driver 36, and the signal distortion on the drain line DL is increased in a position which is more distant from the drain driver 36 in the LCD panel. For this reason, if the correction is performed as shown in FIG. 22(*c*) corresponding to a comparatively upper left matrix position in the layout shown in FIG. 4, optimal signal shaping is executed for the display pixel in the comparatively upper left matrix position as shown in FIG. 22(*d*). However, if the same correction is performed for the pixel in the comparatively lower right matrix position, the correction quantity becomes short as shown in FIG. 22(*e*). As a result, the original pixel signal does not reach a object pixel signal voltage value VPX. On the contrary, the correction quantity suitable for the display pixel in the comparatively lower right matrix position shown in FIG. 23(*c*) is too large for the display pixel in the comparatively upper left matrix position shown in FIG. 23(*e*).

In the fifth embodiment, accordingly, the correction quantity corresponding to the difference between the data Dn−4 for the previous pixel and the data Dn in the same sequence is further regulated with a scale factor corresponding to the matrix position of the pixel. As a result, optimal correction can always be performed corresponding to the matrix position as shown in FIGS. 22(*d*) and 23(*d*).

SIXTH EMBODIMENT

Figure 24:
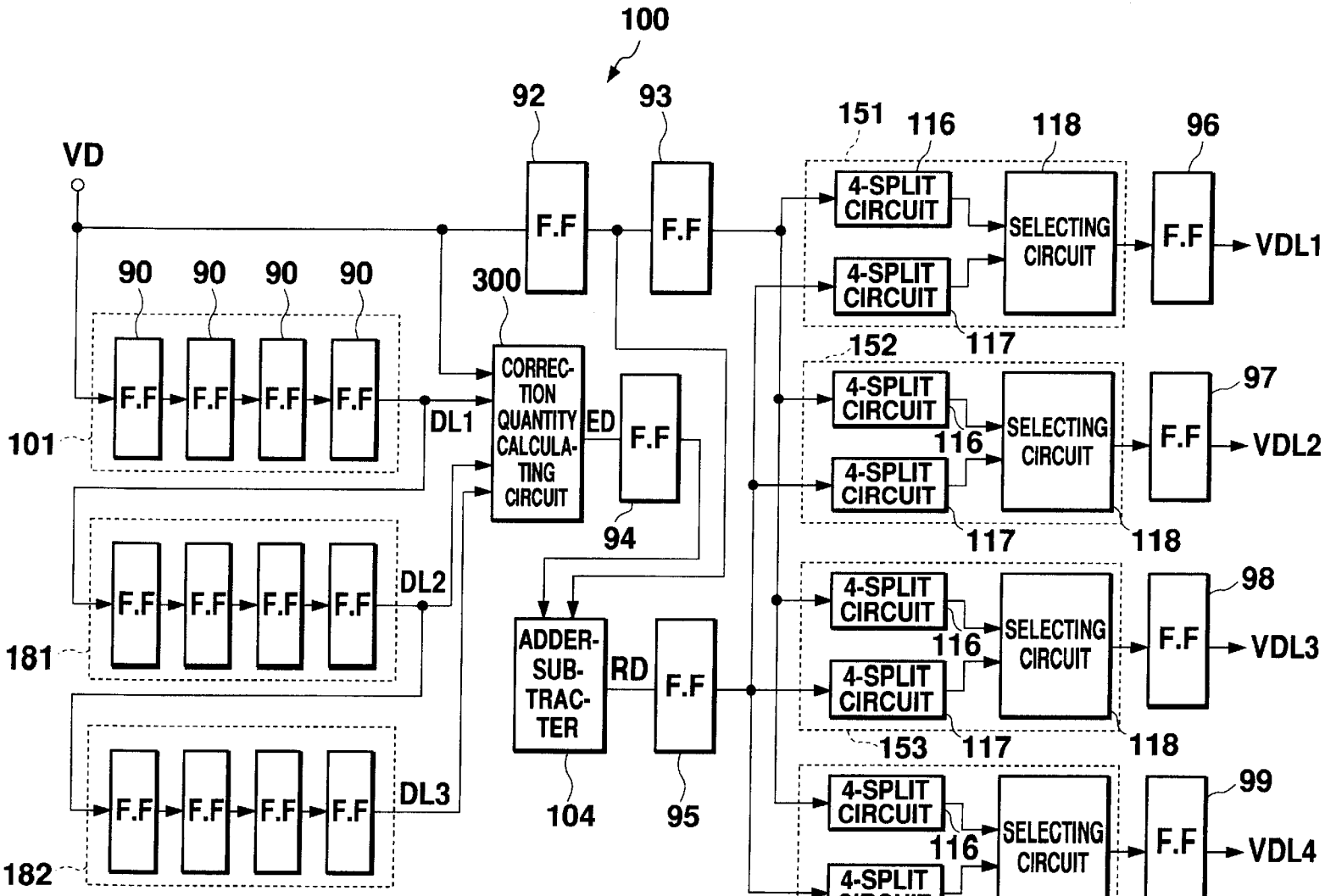
FIG. 24 is a diagram showing a structure of a split correcting circuit 100 according to a sixth embodiment of the present invention.

FIG. 24 shows a structure of a split correcting circuit 100 according to a sixth embodiment of the present invention. The split correcting circuit 100 shown in FIG. 24 forms a part of the structure shown in FIG. 13 in the same manner as in the third embodiment. A circuit structure in FIG. 24 is the same for R, G and B. The split correcting circuit 100 comprises a first delay circuit 101 including four FFs 90, second and third delay circuits 181 and 182, each including four FFs 90, a correction quantity calculating circuit 300, an adder—subtracter 104, and first to fourth split signal generators 151 to 154. The first, second and third delay circuits 101, 181 and 182 are connected in series. The split signal generators 151 to 154 have the same structures as in the third embodiment (see FIGS. 15 and 16). An original pixel signal VD for R, G or B which is a digital signal is sent to the first delay circuit 101. A first delay signal DL 1 output from the first delay circuit 101 is sent to the correction quantity calculating circuit 300 and the second delay circuit 181. A second delay signal DL 2 output from the second delay circuit 181 is sent to the correction quantity calculating circuit 300 and the third delay circuit 182. A third delay signal DL 3 output from the third delay circuit 182 is sent to the correction quantity calculating circuit 300. More specifically, the original pixel signal VD, the signal DL 1 delayed by 1×m (m=4) pixel periods (dots), the second signal DL 2 delayed by 2×m pixel periods, that is, 8 pixel periods, and the third signal DL 3 delayed by $\alpha\times m$ ($\alpha$=3) pixel periods, that is, 12 pixel periods are sent to the correction quantity calculating circuit 300.

The correction quantity calculating circuit 300 examines the original pixel signal VD and the first to third delay signals DL 1 to DL 3, and amplifies or attenuates a difference between the original pixel signal VD corresponding to the current pixel and the original pixel signal obtained four dots before according to an absolute value of the difference and amplitudes of original pixel signals obtained 8 and 12 dots before, thereby creating the correcting data ED, which will be described below in more detail. The original pixel signals obtained 4, 8 and 12 dots before are split and expanded in four sequences, and are then changed into the original pixel data obtained 1 dot, 2 dots and 3 dots before. The correcting data ED is transmitted to the adder—subtracter 104 through a flip-flop 94. The timely original pixel signal VD is sent to the adder—subtracter 104 through a flip-flop 92. The correcting data ED is added to or subtracted from the original pixel signal VD to generate a correction signal RD.

The original pixel signal VD and the correction signal RD are synchronized with each other through flip-flops 93 and 95, and are sent to the first and second split circuits 116 and 117 of the first to fourth split signal generators 151 to 154, respectively. The first to fourth split signal generators 151 to 154 generate optimally split corrected original pixel signals VDL 1, 2, 3 and 4 which include pixel information every four pixels which are different from each other, have a fourfold period in the same manner as in the above-mentioned embodiments. The four-sequence split corrected original pixel signals VDL 1, 2, 3 and 4 are generated for R, G and B in the same manner.

Figure 25:
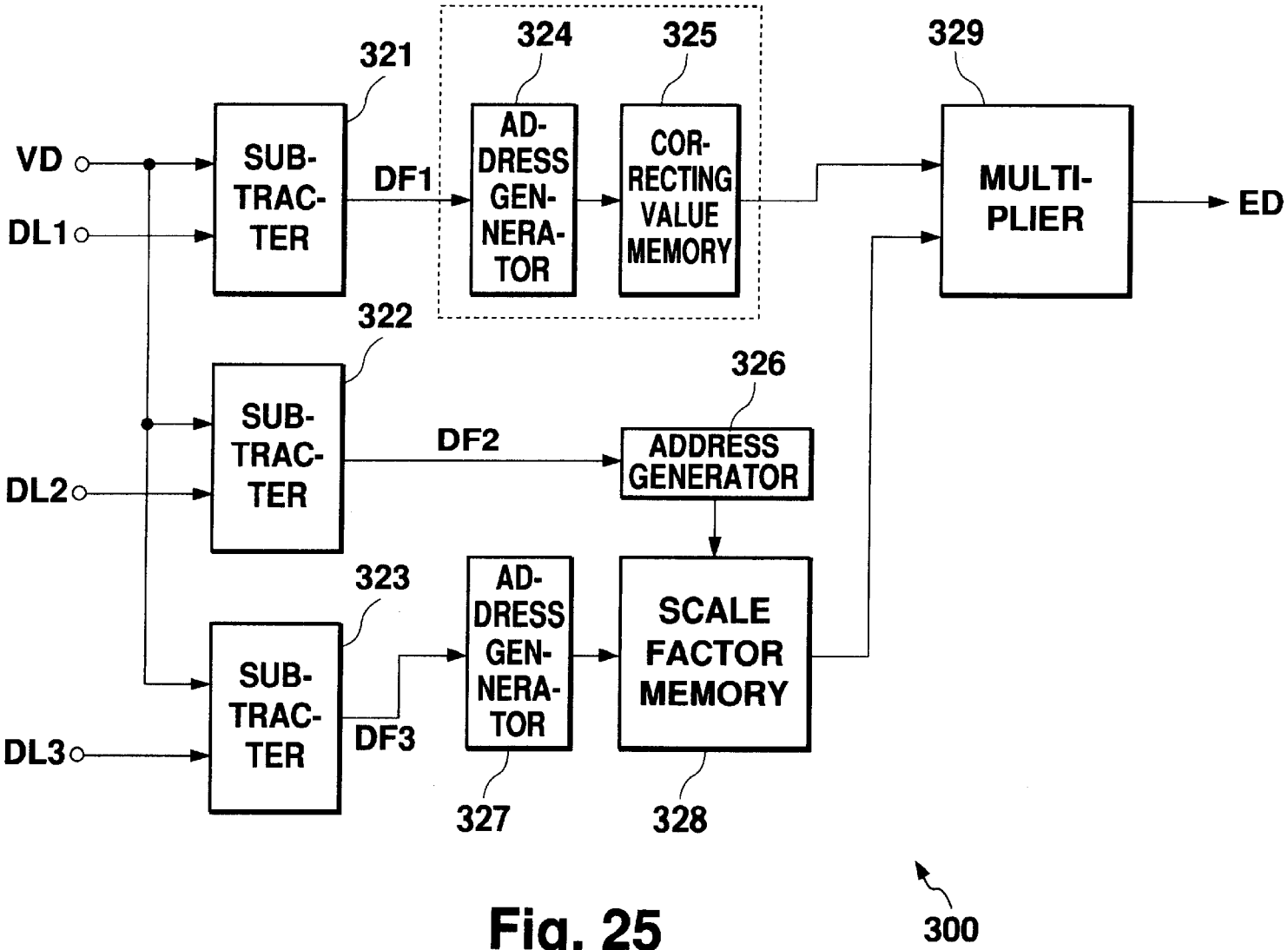
FIG. 25 is a diagram showing a structure of a correction calculating circuit 300 in FIG. 24.

FIG. 25 is a diagram showing a structure of the correction quantity calculating circuit 300 according to the sixth embodiment of the present invention. The correction quantity calculating circuit 300 comprises first to third subtracters 321 to 323, a first address generator 324 and a correcting value memory 325 which form a correcting value generator, a second address generator 326, a third address generator 327, a scale factor memory 328, and a multiplier 329. The original pixel signal VD and the first delay signal DL 1 are sent to the first subtracter 321 so that a first difference signal DF 1 is generated and is sent to the first address generator 324. The first address generator 324 generates an address on the basis of the first difference signal DF 1, and reads a correcting value from the correcting value memory 325. As the difference between the original pixel signal VD and the original pixel signal VD obtained 4 dots before becomes greater, the correcting value is increased. Such correction is to be performed because the signal is distorted more if the difference is increased as described in the above-mentioned embodiments. The read correcting value is sent to the multiplier 329.

Furthermore, the original pixel signal VD and the second and third delay signals DL 2 and DL 3 are sent to the second and third subtracters 322 and 323 respectively, and second and third difference signals DF 2 and DF 3 are generated and sent to the second and third address generators 326 and 327 respectively. Consequently, the second address generator 326 generates a row address and the third address generator 327 generates a column address. A scale factor value on a corresponding address is read from the scale factor memory 328 and is sent to the multiplier 329. The scale factor memory 328 stores scale factors in which the difference between the original pixel signal VD and the original pixel signal obtained 2m dots before (m=split number), that is, 8 dots before in the sixth embodiment, and the difference between the original pixel signal VD and the original pixel signal obtained 3m dots before, that is, 12 dots before, make matrix positions. More specifically, the read scale factor values correspond to the difference between the original pixel signal VD and the original pixel signal obtained 8 pixels before and the difference between the original pixel signal VD and the original pixel signal obtained 12 pixels before. The scale factor values stored in the scale factor memory 328 have greater intervals in a row direction than in a column direction. The reason for this is that the difference between the original pixel signal VD and the original pixel signal obtained 8 dots before affects the original pixel signal VD more than the difference between the original pixel signal VD and the original pixel signal obtained 12 dots before. If importance is attached to the cost of the circuit, the difference signals DF 2 and DF 3 to be sent to the second and third address generators 326 and 327 are decreased to have only predetermined high order bits so that the number of bits of the scale factor memory 328 can be decreased. In this case, the number of bits of the correction quantity is decreased.

The correcting value is multiplied by the scale factor value in the multiplier 329. As a result, correcting data ED is created by regulating the difference between the original pixel signal VD and the original pixel signal obtained 4 dots before according to the same difference and the difference between the original pixel signal VD and the original pixel signals obtained 8 dots and 12 dots before.

Figure 26:
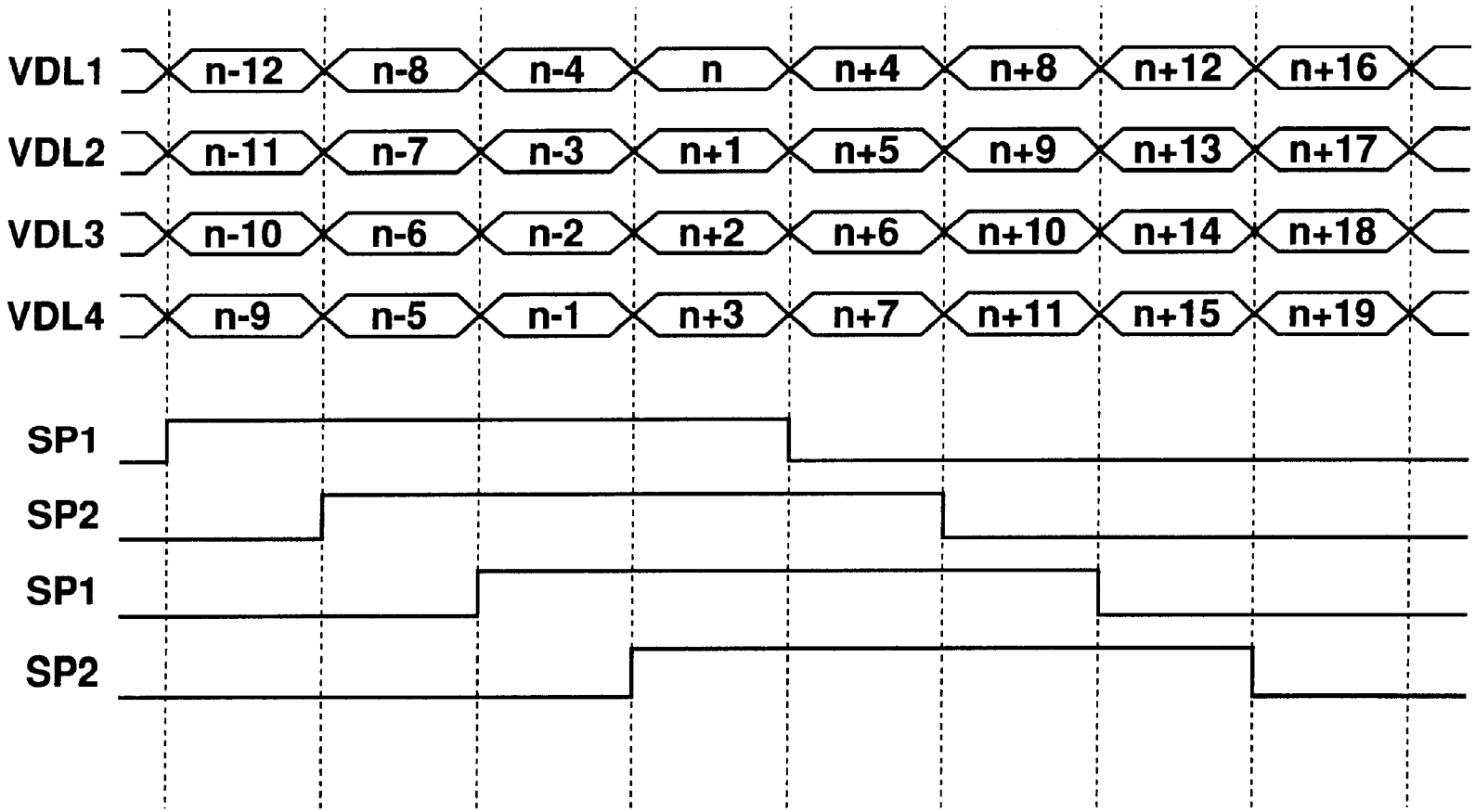
FIG. 26 is a timing chart for explaining operation of a drain driver according to the sixth embodiment.

FIG. 26 is a timing chart for explaining operation of the drain driver 36 according to the sixth embodiment and showing the relationship between the split corrected original pixel signals VDL 1, 2, 3 and 4 and sampling pulses SP 1 and SP 2 output from a two-stage shift register of the drain driver 36 which has the same structure as in FIG. 2. Each of the four split corrected original pixel signals VDL 1, 2, 3 and 4 includes corrected original pixel signals for four pixels which are corrected as described above, that is, VDL 1 (. . . , n−4, n, n+4, . . . ), VDL 2 (. . . , n−3, n+1, n+5, . . . ), VDL 3 (. . . , n−2, n+2, n+6, . . . ), and VDL 4 (. . . , n−1, n+3, n+7, . . . ). The sampling pulses SP 1 and SP 2 which are alternately output from each output stage of the first and second horizontal shift registers 61 and 62 shown in FIG. 2 have ON-state periods which are four times as long as cycles of the corrected original pixel signals VDL 1, 2, 3 and 4. In other words, a sampling period starts three pixels before the pixel signal to be sent to each sequence while a sampling switch 63 is kept ON.

In a high resolution panel, a sampling time assigned to one column is shortened for dot by dot driving operation, that is, a driving operation of outputting the signal sampled from the original pixel signal to the drain line and further to a pixel through no line memory as in the present invention. For this reason, the sampling switch 63 is kept open 3 columns before. Consequently, even if a voltage to be applied to the pixel is delayed for a change in a signal on the video data line 62, the display is not affected. Furthermore, a voltage held by the pixel is obtained the moment the sampling switch 63 is closed. Control is performed in such a manner that the sampling switch 63 is closed after the voltage held for a previous period is changed into a voltage to be held for a next period. For this reason, it is sufficient for a voltage on each drain line to be changed by a difference between an electrical potential level for the previous 3 pixel periods and the object electrical potential level. In this case, the display is suitable for a natural display and an analog display in which the voltage is changed less between adjacent pixels, for example. Furthermore, the sampling period is not restricted to the 4 pixel period but may be a 3 or 5 pixel periods or the like.

As described above, the original pixel signal having the sampling period split into four portions is further multiplied by 4. Consequently, when a 2-stage shift register is used, the 2-stage shift register can use precisely a shift clock having the same frequency as that of the original pixel signal. Therefore, an AND circuit or the like is not necessary.

Figure 27:
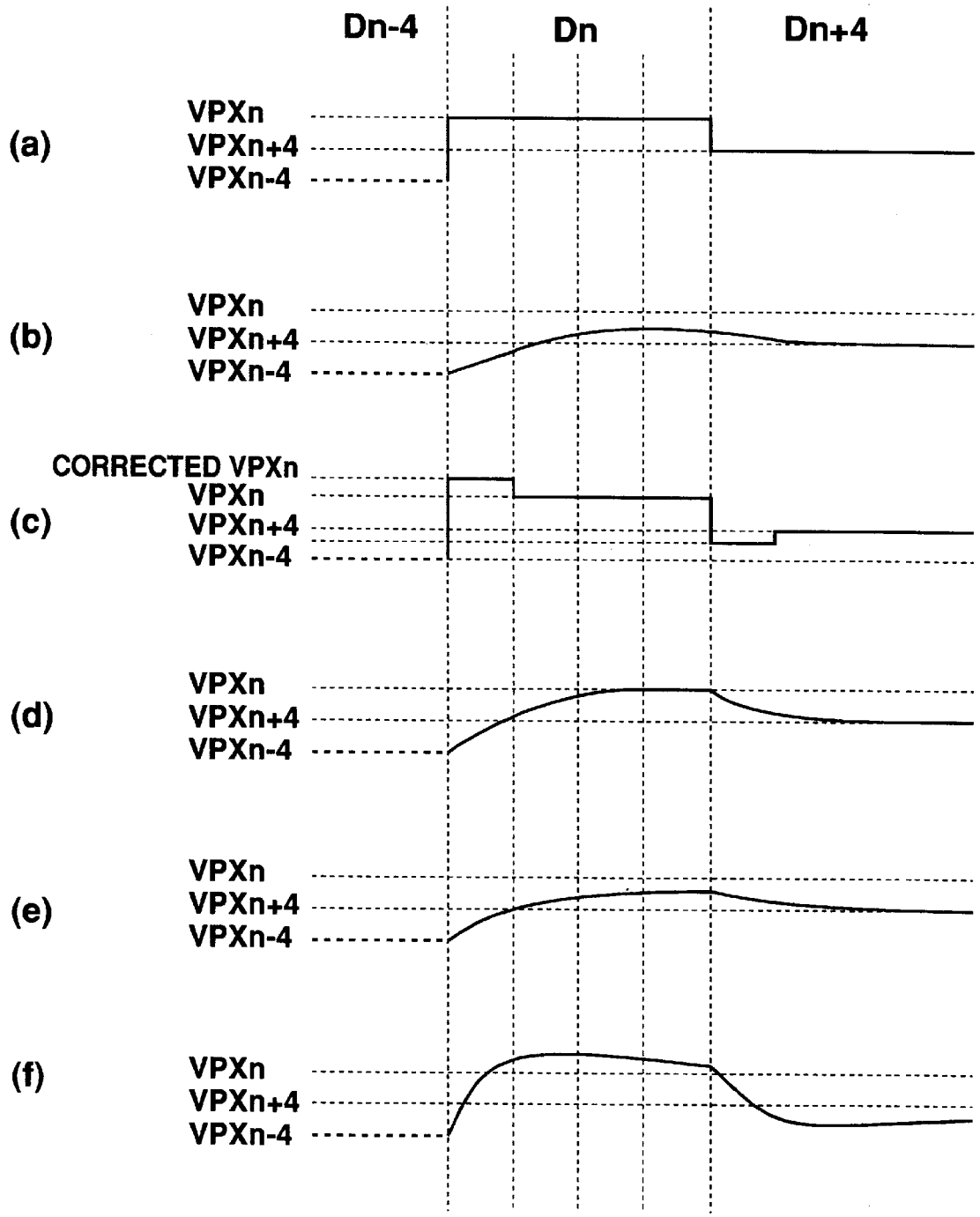
FIG. 27 is diagram for explaining a waveform obtained as a result of correction performed for a split original pixel signal according to the sixth embodiment.

FIG. 27 is a waveform diagram for comparing original pixel signals to be sent to the drain driver 36 shown in FIG. 2. FIG. 27 (*a*) shows a conventional non-corrected waveform of the original pixel signal obtained immediately before it is sent to the drain driver 36. FIG. 27(*b*) shows a signal waveform obtained when the signal of FIG. 27 (*a*) is actually sent to a display pixel. FIG. 27(*c*) shows a waveform of the corrected original pixel signal which is shaped by the structure according to the sixth embodiment and is obtained immediately before the corrected original pixel signal is sent to the drain driver 36. FIG. 27(*d*) shows a signal waveform obtained when the signal of FIG. 27(*c*) is actually sent to each display pixel. FIGS. 27(*e*) and 27(*f*) are comparative examples showing a waveform of the original pixel signal obtained in the case where the original pixel signal is affected by original pixel signals obtained immediately before the same sequence.

The conventional original pixel signal shown in FIG. 27(*a*) is considerably distorted. Consequently, the original pixel signal which is actually sent to the display pixel has the waveform shown in FIG. 27(*b*). For this reason, the sampled original pixel signal does not reach a desirable object voltage value VPX.

In the sixth embodiment, a correction quantity, that is, an amplitude, is regulated according to the difference between the original pixel signal and a split pixel signal VDn−4 corresponding to a previous pixel period, with the difference between the original pixel signal and a split pixel signal VDn−8 obtained 2 periods before, and the difference between the original pixel signal and a split pixel signal VDn−12 obtained 3 periods before in the same sequence for a beginning predetermined period of a split pixel signal period Dn corresponding to the pixel at a digital processing step as shown in FIG. 27(*c*). Consequently, waveform shaping is performed in the same manner as in the fourth embodiment to highlight an edge formed with the previous signal. If the signal VDn is greater than the previous signal Dn−4, the amplitude is set to a higher value. If the signal Dn is smaller than the previous signal Dn−4, the amplitude is set to a smaller value. Consequently, the signal distortion can be relaxed to absorb a convex corrected portion as shown in FIG. 27(*d*), and the object voltage value VPX can be reached for an end of the sampling period of the pixel signal corresponding to each pixel.

In a structure in which the sampling period is longer than a period of each pixel signal shown in FIG. 26, particularly, the signal distortion is affected by previous pixel periods (n−8, n−12) included in the sampling period. For the sampling period, a previous split pixel signal applied to a drain line DL affects a subsequent split pixel signal. In FIG. 27(*e*), for example, pixel signals obtained 2 and 3 periods before (not shown) have comparatively small values and affect the current signal VDn due to a delay, which means that the object voltage VPX cannot be reached. In FIG. 27(*f*), the pixel signals obtained 2 and 3 pixels before have comparatively large values so that the current signal VDn exceeds the object voltage VPX. Thus, it is sometimes insufficient for the current pixel signal to be corrected on the basis of the difference between the current pixel signal and a pixel signal obtained immediately before. In the sixth embodiment, therefore, the difference between the current split pixel signal and the split pixel signal obtained immediately before is corrected on the basis of the difference between the current split pixel signal and split pixel signals obtained 2 and 3 periods before by using the structure shown in FIG. 25. Thus, the above-mentioned problem can be solved.

Figure 28:
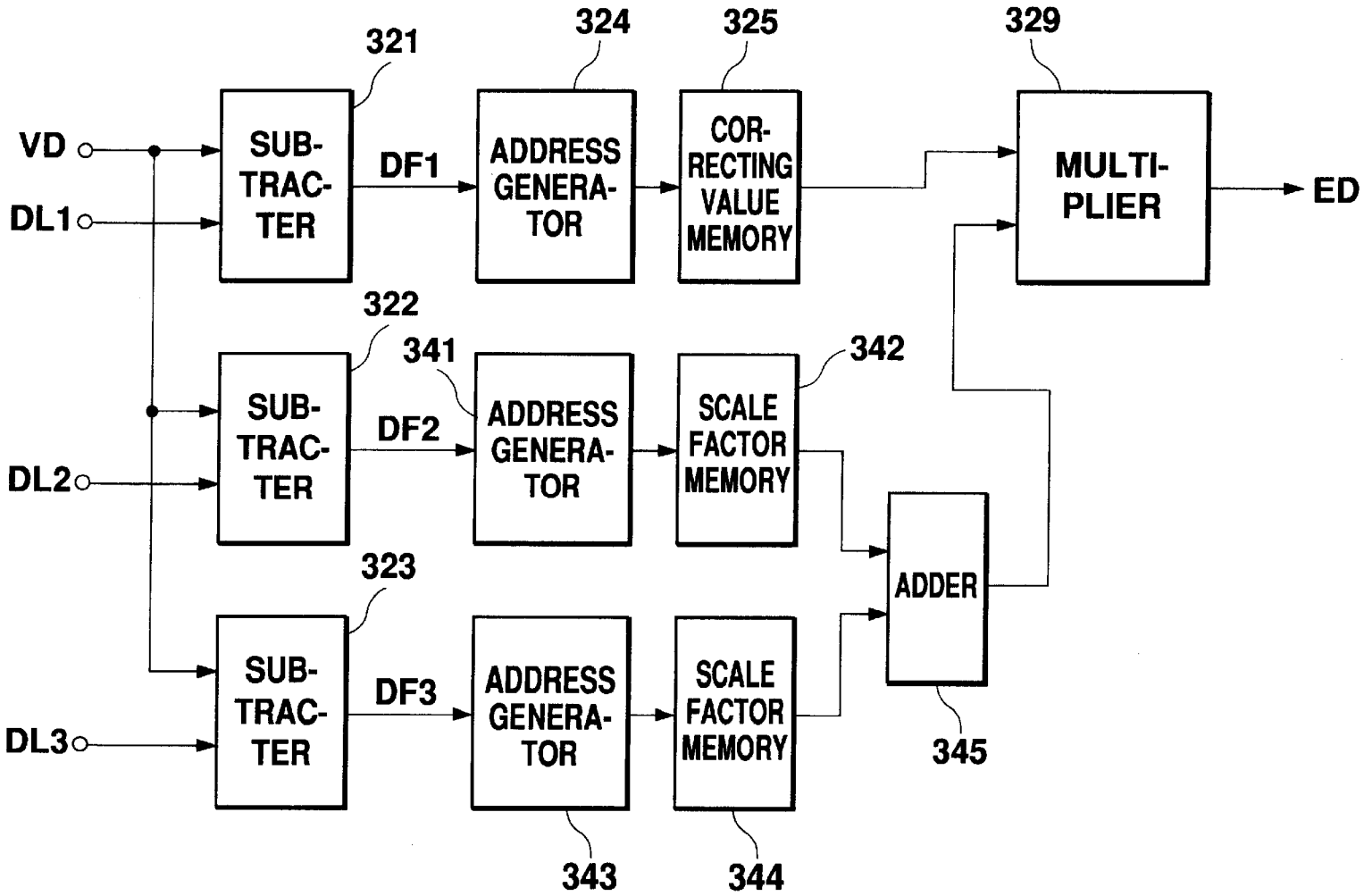
FIG. 28 is a diagram showing another example of the structure of the correction calculating circuit 300 in FIG. 25.

FIG. 28 shows a structure of another correction quantity calculating circuit 300 according to the sixth embodiment. Compared with the correction quantity calculating circuit 300 shown in FIG. 25, fourth and fifth address generators 341 and 343, second and third scale factor memories 342 and 344, and an adder 345 are provided in place of the second and third address generators 326 and 327 and the scale factor memory 328. With the structure shown in FIG. 28, second and third difference signals DF 2 and DF 3 output from second and third subtracters 322 and 323 are sent to the fourth and fifth address generators 341 and 343, respectively. Consequently, addresses are generated by the fourth and fifth address generators 341 and 343, and corresponding scale factor values are read from the second and third scale factor memories 342 and 344, respectively. For the same reason as in the structure shown in FIG. 25, the scale factor values stored in the second scale factor memory 342 have a greater interval than a interval between the scale factor values stored in the third scale factor memory 344. The scale factor values read from the second and third scale factor memories 342 and 344 are added together in the adder 345. As a result, the scale factor value output from the adder 345 is equal to that output from the scale factor memory 328 shown in FIG. 25. The output of the adder 345 is sent to the multiplier 329.

SEVENTH EMBODIMENT

Figure 29:
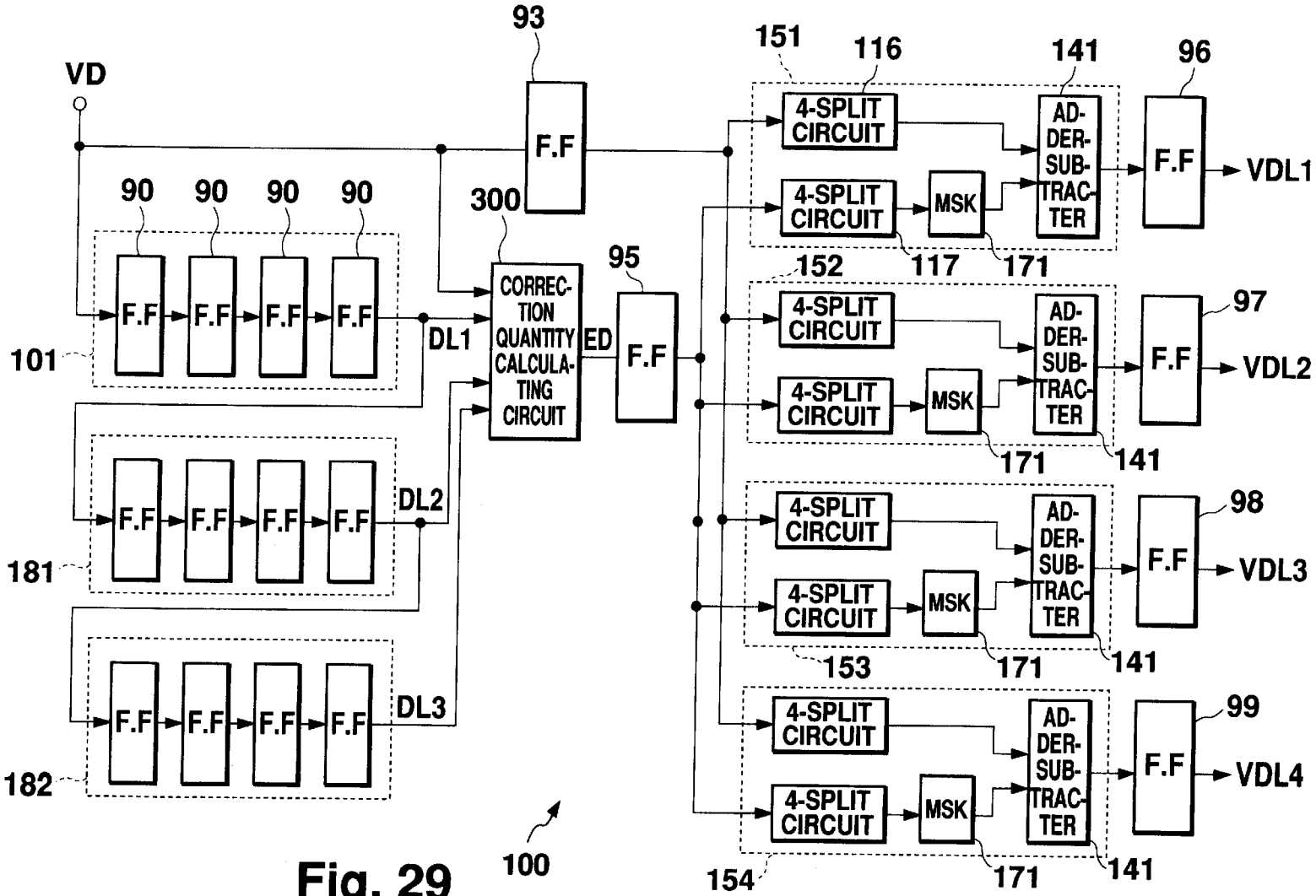
FIG. 29 is a diagram showing a structure of a split correcting circuit 100 according to a seventh embodiment of the present invention.

FIG. 29 shows a structure of a split correcting circuit 100 according to a seventh embodiment of the present invention. The seventh embodiment is different from the sixth embodiment in that correcting data ED sent from a correction quantity calculating circuit 300 is directly transmitted to a second split circuit 117 of each of split signal generators 151, 152, 153 and 154. Each of the split signal generators 151, 152, 153 and 154 includes a mask circuit 171 for masking an output of the second split circuit 117. Because of the existence of the mask circuit 171, the selecting circuit 118 according to the sixth embodiment is unnecessary. Instead, an adder—subtracter 141 for performing addition or subtraction of outputs of a first split circuit 116 and the mask circuit 171 is provided.

With this structure, the correcting data ED sent to the second split circuit 117 is split and expanded in four sequences together with an original pixel signal VD sent to the first split circuit 116. The split and expanded correcting data ED is transmitted to the adder—subtracter 141 in the form of no amplitude for a predetermined period, for example, excluding a first one dot period of each pixel signal period by the mask circuit 171 controlled by the same selection switching clock SEL as in the sixth embodiment. The correcting data ED is then added to or subtracted from split and expanded original pixel signals vd 1, 2, 3 and 4. As a result, the same corrected original pixel signals VDL 1, 2, 3 and 4 as in the sixth embodiment can be obtained.

As is apparent from the foregoing, the original pixel signal to be sent to a display device and the like is split and expanded in a plurality of sequences, and is corrected according to a difference between a signal corresponding to a display pixel and the original pixel signal for a plurality of previous pixel periods in the same sequence. Consequently, signal distortion can be relaxed when the signal is changed, and a contrast ratio and a brightness can be enhanced. Thus, excellent display quality can be obtained.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A driving circuit for a display device in which each of a plurality of pixels includes a switching element for selectively supplying to a display element a pixel signal corresponding to display content, said pixel signal being received via a data line corresponding to said pixel, said pixel signal being selectively outputted to said data line from a data driver at a predetermined timing, said driving circuit comprising:

a signal waveform correcting circuit for highlighting a rising edge and/or a falling edge of a waveform in the vicinity of a boundary between unit pixel periods of an input pixel signal so as to correct a waveform of an output pixel signal to be supplied from said data driver to each data line;

said signal waveform correcting circuit including:

a delay circuit for delaying said input pixel signal by a natural number m pixel periods;

a difference calculating circuit for calculating a difference between said input pixel signal and a delay signal of said input pixel signal output from said delay circuit;

a correction signal generator for generating a correction signal on the basis of an amplitude of a difference signal sent from said difference calculating circuit; and a signal split expansion circuit for generating, from said input pixel signal, m split pixel signals in an m-fold period of a pixel clock having pixel information every m pixel periods, for generating, from said correction signal, m split correction signals in an m-fold period of a pixel clock, and for outputting m corrected split pixel signals obtained by amplifying or attenuating a part of said split pixel signal by said split correction signal on the basis of said m split pixel signals and said m split correction signals corresponding thereto.

2. The driving circuit for a display device according to claim 1, wherein said correction signal generator includes:

a correction regulating circuit for outputting correcting data on the basis of an amplitude of a difference signal sent from said difference calculating circuit; and an adder—subtracter for performing addition or subtraction of said correcting data and said input pixel signal to generate said correction signal, and wherein said signal split expansion circuit switches and selects said m split pixel signals and corresponding m split correction signals in a predetermined period by a selecting circuit, thereby generating m corrected split pixel signals.

3. The driving circuit for a display device according to claim 1, wherein said correction signal generator includes:

a correction regulating circuit for outputting correcting data as said correction signal on the basis of an amplitude of a difference signal sent from said difference calculating circuit, and wherein said signal split expansion circuit has an adder—subtracter to add or subtract said corresponding m split correction signals to or from said m split pixel signals only for a predetermined period, thereby generating said corrected split signal.

4. A driving circuit for a display device in which each of a plurality of pixels includes a switching element for selectively supplying to a display element a pixel signal corresponding to display content, said pixel signal being received via a data line corresponding to said pixel, said pixel signal being selectively outputted to said data line from a data driver at a predetermined timing, said driving circuit comprising:

a signal waveform correcting circuit for highlighting a rising edge and/or a falling edge of a waveform in the vicinity of a boundary between unit pixel periods of an input pixel signal so as to correct a waveform of an output pixel signal to be supplied from said data driver to each data line;

said signal waveform correcting circuit including:

a delay circuit for delaying said input pixel signal by a natural number m pixel periods;

a difference calculating circuit for calculating a difference between said input pixel signal and a delay signal of said input pixel signal output from said delay circuit;

a correction signal generator for generating a correction signal on the basis of an amplitude of a difference signal sent from said difference calculating circuit; and a signal split expansion circuit for generating, from said input pixel signal, m split pixel signals in an m-fold period of a pixel clock having pixel information every m pixel periods, for generating, from said correction signal, m split correction signals in an m-fold period of a pixel clock, and for outputting m corrected split pixel signals obtained by amplifying or attenuating a part of said split pixel signal by said split correction signal on the basis of said m split pixel signals and said m split correction signals corresponding thereto, wherein said signal split expansion circuit is constructed with m signal split circuits, and uses 1 to m sampling clocks having phases which are different from each other by a 1/m period and having m-fold period of a reference pixel clock of said input pixel, and said m signal split circuits forming m correction split pixel signals in phase which have different pixel information.

5. The driving circuit for a display device according to claim 4, wherein 1st to [m−1]th signal split circuits include respectively:

a first latch circuit for latching said input pixel signal and said correction signal sent from said correction signal generator respectively on the basis of any of 1st to [m−1]th sampling clocks;

a second latch circuit for latching respective output signals sent from said first latch circuit on the basis of an mth sampling clock; and a selecting circuit for selectively switching and outputting any of 1st to [m−1]th split pixel signals and any of corresponding 1st to [m−1]th split correction signals which are output from said second latch circuit on the basis of a predetermined selection clock, thereby generating corresponding 1st to [m−1]th corrected split pixel signals, and wherein an mth signal split circuit includes:

a latch circuit for latching said input pixel signal and said correction signal sent from said correction signal generator on the basis of said mth sampling clock;

a selecting circuit for selectively switching and outputting an mth split pixel signal and a corresponding mth split correction signal which are output from said latch circuit on the basis of a predetermined selection clock, thereby generating a corresponding mth corrected split pixel signal.

6. The driving circuit for a display device which sequentially drives a plurality of display pixels arranged in a matrix, said plurality of display pixels each including a display element and a switching element for selectively supplying to said display element a signal corresponding to display content, said driving circuit comprising:

a signal waveform correcting circuit for correcting an input pixel signal for driving each display pixel, said signal being supplied to said display pixel via said switching element, wherein said signal waveform correcting circuit amplifies or attenuates an amplitude of an input pixel signal for a beginning predetermined period of a unit pixel period in which each display pixel is driven depending on a difference between said input pixel signal for a past unit pixel period and said input pixel signal for a current unit pixel period and a position of said display pixel on a display section corresponding to said current unit pixel period, and said signal waveform correcting circuit includes:

a delay circuit for delaying said input pixel signal by a natural number m pixel periods;

a difference calculating circuit for calculating a difference between said input pixel signal and a delay signal of said input pixel signal output from said delay circuit;

a correction signal generator having a position information generator for generating position information of a corresponding display pixel and serving to generate a correction signal on the basis of said position information and a difference signal sent from said difference calculating circuit; and a signal split expansion circuit for generating, from said input pixel signal, m split pixel signals in an m-fold period of a pixel clock having pixel information every m pixel periods, for generating, from said correction signal, m split correction signals in an m-fold period of a pixel clock, and for generating corrected split pixel signals from said m split pixel signals and said m split correction signals corresponding thereto, wherein an amplitude of said split pixel signal for a beginning predetermined period of one unit pixel period of said m pixel periods is amplified or attenuated depending on a difference between said input pixel signal for a past unit pixel period and said input pixel signal for a current unit pixel period, and a position of said display pixel on a display section corresponding to said current unit pixel period.

7. The driving circuit for a display device according to claim 6, wherein said correction signal generator further includes:

a correction regulating circuit for outputting correcting data corresponding to said position information and a difference signal sent from said difference calculating circuit; and an adder—subtracter for performing addition or subtraction of said correcting data and said input pixel signal to generate said correction signal, and wherein said signal split expansion circuit switches and selects said m split pixel signals and said corresponding m split correction signals in a predetermined period by a selecting circuit, thereby generating m corrected split pixel signals.

8. The driving circuit for a display device according to claim 6, wherein said correction signal generator includes:

a correction regulating circuit for outputting correcting data as said correction signal on the basis of an amplitude of a difference signal sent from said difference calculating circuit, and said signal split circuit includes an adder—subtracter to add or subtract said corresponding m split correction signals to or from said m split pixel signals in a predetermined timing, thereby generating corrected split pixel signals.

9. A driving circuit for a display device which sequentially drives a plurality of display pixels arranged in a matrix, said plurality of display pixels each including a display element and a switching element for selectively supplying to said display element a signal corresponding to display content, said driving circuit comprising:

a signal waveform correcting circuit for correcting an input pixel signal for driving each display pixel, said signal being supplied to said display pixel via said switching element, said signal waveform correcting circuit including:

a delay circuit for delaying said input pixel signal by a natural number m pixel periods;

a difference calculating circuit for calculating a difference between said input pixel signal and a delay signal of said input pixel signal output from said delay circuit;

a correction signal generator having a position information generator for generating position information of a corresponding display pixel and serving to generate a correction signal on the basis of said position information and a difference signal sent from said difference calculating circuit; and a signal split expansion circuit for generating, from said input pixel signal, m split pixel signals in an m-fold period of a pixel clock having pixel information every m pixel periods, for generating, from said correction signal, m split correction signals in an m-fold period of a pixel clock, and for generating corrected split pixel signals from said m split pixel signals and said m split correction signals corresponding thereto, wherein an amplitude of said split pixel signal for a beginning predetermined period of one unit pixel period of said m pixel periods is amplified or attenuated depending on a difference between said input pixel signal for a past unit pixel period and said input pixel signal for a current unit pixel period, and a position of said display pixel on a display section corresponding to said current unit pixel period, and said beginning predetermined period of said unit pixel period, in which said amplitude of said split pixel signal is controlled, is one pixel period of said input pixel signal.

10. A driving circuit for a display device which sequentially drives a plurality of display pixels arranged in a matrix, said plurality of display pixels each including a display element and a switching element for selectively supplying to said display element a signal corresponding to display content, said driving circuit comprising:

a signal waveform correcting circuit for correcting an input pixel signal for driving each display pixel, said signal being supplied to said display pixel via said switching element, wherein said signal waveform correcting circuit amplifies or attenuates an amplitude of an input pixel signal for a beginning predetermined period of a unit pixel period corresponding to each display pixel depending on a difference between an input pixel signal for a plurality of past unit pixel periods and an input pixel signal for a current unit pixel period, and influence of a difference between an input pixel signal for a closer past unit pixel period and said input pixel signal for said current unit pixel period on said corrected input pixel signal is set greater than influence of a difference between an input pixel signal for a farther past unit pixel period and said input pixel signal for said current unit pixel period on said corrected input pixel signal.

11. A driving circuit for a display device which sequentially drives a plurality of display pixels arranged in a matrix, said plurality of display pixels each including a display element and a switching element for selectively supplying to said display element a signal corresponding to display content, said driving circuit comprising:

a signal waveform correcting circuit for correcting an input pixel signal for driving each display pixel, said signal being supplied to said display pixel via said switching element, wherein said signal waveform correcting circuit amplifies or attenuates an amplitude of an input pixel signal for a beginning predetermined period of a unit pixel period corresponding to each display pixel depending on a difference between an input pixel signal for a plurality of past unit pixel periods and an input pixel signal for a current unit pixel period, and said signal waveform correcting circuit includes:

a delay circuit for delaying said input pixel signal by $\alpha \cdot m$ pixel periods, m being a natural number and a being an integer of 1 or more;

a difference calculating circuit for calculating a difference between said input pixel signal and delay signals obtained by a delay of $1 \cdot m$ to $\alpha \cdot m$ pixel periods and output from said delay circuit, respectively;

a correction signal generator for generating a correction signal on the basis of $\alpha$ difference signals sent from said difference calculating circuit; and a signal split expansion circuit for generating, from said input pixel signal, m split pixel signals having pixel information every m pixel periods, for generating, from said correction signal, m split correction signals, and for generating corrected split pixel signals from said m split pixel signals and said corresponding m split correction signals, wherein said m pixel periods act as a unit pixel period, and an amplitude of said split pixel signal for a beginning predetermined period of said unit pixel period is amplified or attenuated in response to said correction signal.

12. The driving circuit for a display device according to claim 11, wherein said correction signal generator changes a first difference signal which is a difference between said input pixel signal and a delay signal obtained by delaying said input pixel signal by 1·m pixel periods on the basis of other [α−1] difference signals which are differences between said input pixel signal and delay signals obtained by a delay of 2·m pixel periods or more, thereby creating correcting data and generating a correction signal on the basis of said correcting data.

13. The driving circuit for a display device according to claim 11, wherein said corrected split pixel signal generated by correcting said input pixel signal is generated by reflecting the newest first difference signal which is a difference between said input pixel signal and a delay signal obtained by delaying said input pixel signal by 1·m pixel periods more than other [α−1] difference signals.

14. The driving circuit for a display device according to claim 11, wherein said correction signal generator includes:

a correction calculating circuit for changing an amplitude of a first difference signal which is a difference between said input pixel signal and a delay signal obtained by delaying said input pixel signal by 1·m pixel periods on the basis of said amplitude and other [α−1] difference signals which are differences between said input pixel signal and delay signals obtained by a delay of 2·m pixel periods or more, thereby generating correcting data; and an adder—subtracter for performing addition or subtraction of said correcting data and said input pixel signal to generate a correction signal, and wherein said signal split expansion circuit includes:

an original pixel signal split circuit for generating, from said input pixel signal, m split pixel signals in an m-fold period of a pixel clock having pixel information every m pixel periods;

a correction signal split circuit for generating, from said correction signal, m split correction signals in an m-fold period of a pixel clock; and a selecting circuit for selectively switching said m split pixel signals and said corresponding m split correction signals in a predetermined period to output a corrected split pixel signal.

15. The driving circuit for a display device according to claim 11, wherein said correction signal generator changes an amplitude of a first difference signal which is a difference between said input pixel signal and a delay signal obtained by delaying said input pixel signal by 1·m pixel periods on the basis of said amplitude and other [α−1] difference signals which are differences between said input pixel signal and delay signals obtained by a delay of 2·m pixel periods or more, thereby generating a correction signal, and wherein said signal split expansion circuit includes:

an original pixel signal split circuit for generating, from said input pixel signal, m split pixel signals in an m-fold period of a pixel clock having pixel information every m pixel periods;

a correction signal split circuit for generating, from said correction signal, m split correction signals in an m-fold period of a pixel clock; and an adder—subtracter for adding or subtracting said corresponding m split correction signals to or from said m split pixel signals in a predetermined period, thereby generating a corrected split pixel signal.

16. The driving circuit for a display device according to claim 11, wherein a beginning predetermined period of said unit pixel period in which said amplitude of said split pixel signal is controlled is one pixel period of said input pixel signal.

17. The driving circuit for a display device according to claim 11, wherein a sampling period for sending a display signal to each display pixel is set longer than one unit pixel period.

* * * * *

UNITED STATES PATENT AND TRADEMARK OFFICE

CERTIFICATE OF CORRECTION

PATENT NO. : 6,329,980 B1
DATED : December 11, 2001
INVENTOR(S) : Uehara et al.

It is certified that error appears in the above-identified patent and that said Letters Patent is hereby corrected as shown below:

Title page,
Item [73], change "Sanjo Electric Co., Ltd." to -- Sanyo Electric Co., Ltd. --.

Signed and Sealed this

Thirtieth Day of April, 2002

*Attest:*

*Attesting Officer*

JAMES E. ROGAN
*Director of the United States Patent and Trademark Office*